US011484751B2

(12) United States Patent
Davide

(10) Patent No.: US 11,484,751 B2
(45) Date of Patent: Nov. 1, 2022

(54) ADJUSTABLE EXERCISE PLANK MACHINE

(71) Applicant: Vicki C. Davide, Massillon, OH (US)

(72) Inventor: Vicki C. Davide, Massillon, OH (US)

( * ) Notice: Subject to any disclaimer, the term of this patent is extended or adjusted under 35 U.S.C. 154(b) by 185 days.

(21) Appl. No.: 16/818,529

(22) Filed: Mar. 13, 2020

(65) Prior Publication Data

US 2020/0289884 A1 Sep. 17, 2020

Related U.S. Application Data

(60) Provisional application No. 62/819,178, filed on Mar. 15, 2019.

(51) Int. Cl.

| | |
|---|---|
| ***A63B 23/02*** | (2006.01) |
| ***A63B 21/002*** | (2006.01) |
| ***A63B 21/00*** | (2006.01) |

(52) U.S. Cl.

CPC ..... *A63B 23/02* (2013.01); *A63B 21/0023* (2013.01); *A63B 21/00047* (2013.01); *A63B 21/4035* (2015.10); *A63B 2225/09* (2013.01)

(58) Field of Classification Search

CPC ..... A63B 21/00047; A63B 21/0023; A63B 21/0083; A63B 21/4034; A63B 21/4035; A63B 23/02; A63B 23/0205; A63B 23/0211; A63B 23/0216; A63B 23/0222; A63B 23/0227; A63B 23/0233; A63B 23/0238; A63B 2071/024; A63B 2225/09; A63B 2225/093

See application file for complete search history.

(56) References Cited

U.S. PATENT DOCUMENTS

| | | | | |
|---|---|---|---|---|
| 3,572,701 A * | 3/1971 | Agamian | A63B 23/1227 482/132 |
| 3,589,720 A * | 6/1971 | Agamian | A63B 22/203 482/114 |
| 4,149,713 A * | 4/1979 | McLeod | A63B 23/03533 601/24 |
| 4,948,121 A * | 8/1990 | Haaheim | A63B 22/0012 482/70 |
| 5,330,408 A * | 7/1994 | Westmoreland, Jr. | A63B 23/12 482/141 |
| 5,518,483 A * | 5/1996 | Oswald | A63B 21/012 482/130 |
| 7,585,263 B2 * | 9/2009 | Brown | A63B 22/203 482/142 |

(Continued)

*Primary Examiner* — Joshua Lee

(74) *Attorney, Agent, or Firm* — Sand, Sebolt & Wernow Co., LPA

(57) ABSTRACT

An exercise machine for assisting in the performance of a core exercise that is adjustable between a plurality of configurations. The exercise machine includes a front track, a rear track, a first bar operably engaged with the front track and the rear track, a second bar operably engaged with the front track and the rear track, a first handle member operably engaged with the first bar proximate, a second handle member operably engaged with the second bar, a first foot block operably engaged with the first bar, and a second foot block operably engaged with the second bar. The first bar, the second bar, the first handle member, the second handle member, the first foot block, and the second foot block are all selectively adjustable to accommodate users of different shapes and heights as well as variations of core exercises.

24 Claims, 21 Drawing Sheets

(56) References Cited

U.S. PATENT DOCUMENTS

| | | | | |
|---|---|---|---|---|
| 8,137,250 | B1 * | 3/2012 | Caban | A63B 23/0216 482/52 |
| 9,022,909 | B2 * | 5/2015 | Kermath | A63B 21/0428 482/133 |
| 9,265,986 | B1 * | 2/2016 | Godak | A63B 23/03541 |
| 9,814,927 | B2 * | 11/2017 | Forystek | A63B 21/4035 |
| 9,873,016 | B2 * | 1/2018 | Ellis | A63B 21/00069 |
| 10,029,141 | B2 * | 7/2018 | Lagree | A63B 21/4033 |
| 10,201,724 | B2 * | 2/2019 | Lagree | A63B 21/0428 |
| 10,493,321 | B2 * | 12/2019 | Lagree | A63B 23/0429 |
| 11,013,954 | B2 * | 5/2021 | Schwarz | A63B 21/0428 |
| 2004/0167000 | A1 * | 8/2004 | Schwarz | A63B 23/03541 482/129 |
| 2008/0070766 | A1 * | 3/2008 | Brown | A63B 23/03525 482/140 |
| 2010/0048367 | A1 * | 2/2010 | Liang | A63B 23/03525 482/145 |
| 2014/0011645 | A1 * | 1/2014 | Johnson | A63B 23/03525 482/121 |
| 2014/0031175 | A1 * | 1/2014 | Peralo | A63B 21/4045 482/66 |
| 2015/0065318 | A1 * | 3/2015 | Lagree | A63B 21/055 482/130 |
| 2017/0014667 | A1 * | 1/2017 | Barnett | A63B 23/03525 |

* cited by examiner

ADJUSTABLE EXERCISE PLANK MACHINE

CROSS REFERENCE TO RELATED APPLICATIONS

This application claims the benefit of U.S. Provisional Application Ser. No. 62/819,178, filed on Mar. 15, 2019; the disclosure of which is incorporated herein by reference.

TECHNICAL FIELD

The present disclosure relates to exercise machines. More particularly, the present disclosure relates to an exercise machine for assisting in the performance of core exercises. Specifically, the present disclosure relates to an exercise machine for assisting in the performance of core exercises that is adjustable between a plurality of configurations.

BACKGROUND

Background Information

Improving core strength is beneficial for many reasons. One beneficial exercise for improving core strength is known as a plank. Although there are many variations, a plank exercise may be generally defined as an isometric core strength exercise that involves maintaining a position similar to a push-up for a certain period of time. One of the issues with doing planks is that the person must position their body correctly so that the exercise is effective. Incorrect positioning of the body may lead to injury, particularly of the ribs, shoulder joints and the back.

Another beneficial exercise for improving core strength is an exercise where a person begins in a typical plank position and moves one of their knees towards their midsection to a maximum movement point. Once the maximum movement point has been reached, the person typically briefly holds their knee in that position while flexing their abs. After the person briefly holds their knee in that position, the person returns that knee to the original position and the person performs the same movement with their other knee. As such, the person moves their knees in an alternating manner. Alternatively, the person may move both of their knees toward their midsection to a maximum movement point. Once the maximum movement point has been reached, the person typically briefly holds both knees in that position while flexing their abs. After the person briefly holds their knees in that position, the person returns both knees to the original position. As such, the person moves their knees simultaneously. Performing moving planks, where the person must position their body correctly so that the exercise is effective. As stated above, incorrect positioning of the body may lead injury, particularly of the ribs, shoulder joints and the back.

SUMMARY

The exercise machine disclosed herein may help a person position their arms and feet so as to be able to perform a variety of core exercises more effectively.

In one aspect, the present disclosure may provide a machine for performing core exercises, comprising: at least one track; at least one bar engaged with the at least one track; at least one handle bar assembly; and at least one foot block engaged with the at least one bar. This embodiment or another embodiment may provide for the at least one track comprises; a front track; and a rear track spaced longitudinally rearwardly from the front track and aligned substantially parallel to the front track. This embodiment or another embodiment may provide for the at least one bar comprises: a first bar operably engaged with the front track and the rear track; and a second bar operably engaged with the front track and the rear track; wherein the second bar is oriented substantially parallel to the first bar and is spaced transversely therefrom. This embodiment or another embodiment may provide for the at least one handle bar assembly comprises: a first handle bar assembly operably engaged with the first bar proximate a first end of the first bar; and a second handle bar assembly operably engaged with the second bar proximate a first end of the second bar. This embodiment or another embodiment may provide for a first handle member provided on the first handle bar assembly; and a second handle member provided on the second handle bar assembly; wherein the first handle member is located at a first height relative to the first bar; and the second handle member is located at a second height relative to the second bar; and wherein one or both of the first height and the second height is selectively adjustable. This embodiment or another embodiment may provide for the first bar includes a first end and a second end; and the second bar includes a first end and a second end; and wherein the exercise machine further comprises: a first distance of the first foot block from the second end of the first bar; and a second distance of the second foot block from the second end of the second bar; and wherein one or both of the first distance and the second distance is selectively adjustable. This embodiment or another embodiment may provide for a first foot block operably engaged with the first bar a distance longitudinally rearward from the first handle bar assembly; and a second foot block operably engaged with the second bar a distance longitudinally rearward from the second handle bar assembly. This embodiment or another embodiment may provide for one or both of the first bar and the second bar is selectively adjustable in the transverse direction along the front track and along the rear track. This embodiment or another embodiment may provide for the at least one handle bar assembly comprises: at least on handle bar; and at least one platform adapted to accept a forearm of a user. This embodiment or another embodiment may provide for at least one piston engaged with the at least one foot block. This embodiment or another embodiment may provide for a first piston operatively coupled to a first foot block; and a second piston operatively coupled to a second foot block.

In another aspect, the present disclosure may provide a machine for performing core exercises, comprising: at least one track; at least one bar engaged with the at least one track; at least one handle bar assembly; and at least one foot acceptor engaged with the at least one bar. This embodiment or another embodiment may provide for the at least one foot acceptor further comprises: at least one ball and socket attached to the foot acceptor unit operative to provide unlimited axial rotation and unlimited universal radial movement. This embodiment or another embodiment may provide for the at least one foot acceptor further comprises: at least one strap that spans from a first side to the second side of the at least one foot acceptor operative to hold at least one foot of a user. This embodiment or another embodiment may provide for the at least one handle bar assembly comprises: at least on handle bar; at least one platform adapted to accept a forearm of a user.

In yet another aspect, the present disclosure may provide a method of performing a core exercise, comprising: selectively adjusting one or more of: a position of one or both of a first bar and a second bar along a front track and a rear track in the transverse direction; a first height of a first handle member assembly relative to the first bar; a second height of a second handle member relative to the second bar; a first distance of a first foot block from the front track; and a second distance of a second foot block from the front track; engaging a first foot of the user in the first foot block; engaging a second foot of the user in the second foot block; gripping the first handle member on the first handle bar assembly with a first hand of a user; gripping the second handle member of the second handle bar assembly with a second hand of the user; and performing a core exercise. This embodiment or another embodiment may provide prior to gripping the first handle member: removing the first handle member; removing the second handle member; attaching a plank member; and engaging the plank member with at least one forearm of the user. This embodiment or another embodiment may provide the engaging steps further comprise: adjusting a first foot acceptor attached to a ball and socket; strapping the first foot into the first foot acceptor; adjusting a second foot acceptor attached to a ball and socket; and strapping the second foot into the second foot acceptor. This embodiment or another embodiment may provide the step of performing further comprises: moving at least one foot of a user along one of the front track and rear track; engaging a piston rod with a cylinder attached to a foot block as a result of the movement; and providing additional resistance to the user as a result of the movement of the piston rod. This embodiment or another embodiment may provide the performing of the core exercise is done without any movement of the first foot or second foot of the user.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

FIG. 1 through FIG. 6 show an adjustable exercise machine in accordance with an aspect of the present disclosure, generally depicted at 10. Exercise machine 10 is configured to assist a user in the performance of a core exercise.

Figure 1:
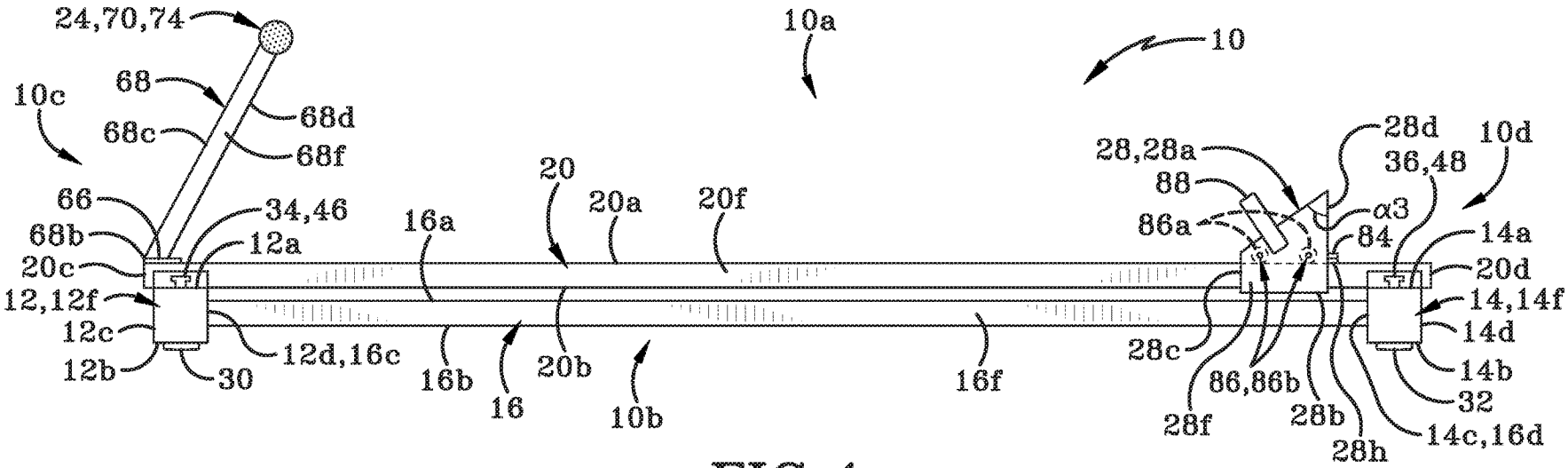
FIG. 1 is a side elevation view of a first embodiment of an adjustable exercise machine in accordance with one aspect of the present disclosure.
Figure 2:
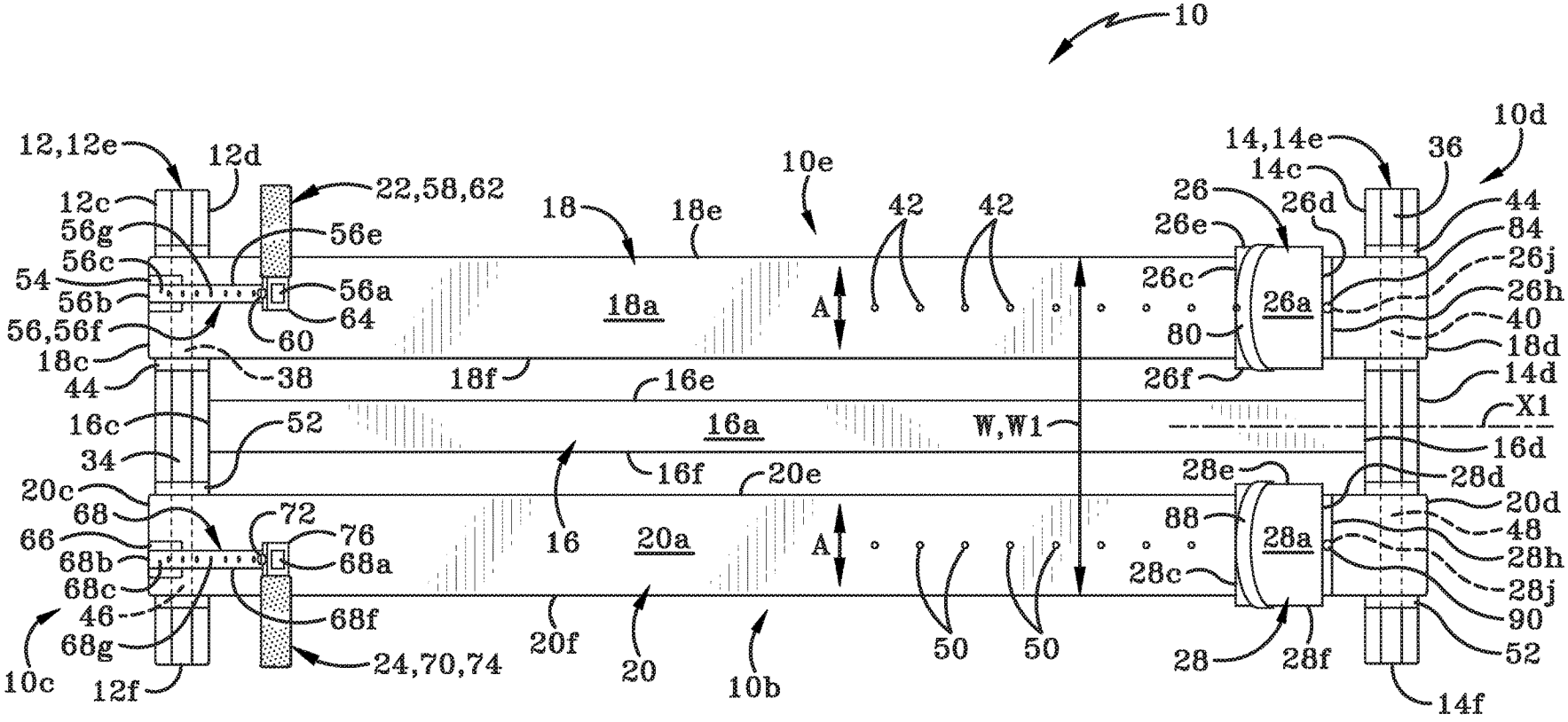
FIG. 2 is top plan view of the adjustable exercise machine of FIG. 1 showing a first bar and a second bar in a first position laterally relative to a center support beam; a first handle assembly and a second handle assembly in a same position vertically relative to the first bar and second bar; and a first foot block and second foot block in a same position longitudinally relative to a first end of the exercise machine.

Exercise machine 10 generally includes a top 10*a* (FIG. 1), a bottom 10*b*, first end 10*c*, a second end 10*d*, a first side 10*e* (FIG. 2), and a second side 10*f* (FIG. 2). Top 10*a* and bottom 10*b* define a vertical direction therebetween; first and second ends 10*c*, 10*d* define a longitudinal direction therebetween; and first and second sides 10*e*, 10*f* define a transverse direction therebetween. Exercise machine 10 further includes a longitudinal center axis X1 extending between first end 10*c* and second end 10*d*.

With primary reference to FIG. 1 and FIG. 2, exercise machine 10 further includes a front track 12, a rear track 14, and a center support beam 16 that extends between front track 12 and rear track 14. Center support beam 16 extends along longitudinal center axis X1 Front track 12 and rear track 14 are oriented generally at right angles to center support beam 16 and thereby to center axis X1. Front track 12, rear track 14, and center support beam 16 form an "I-shaped" frame when view from above. Exercise machine 10 further comprises a first bar 18 and a second bar 20 that extend between front track 12 and rear track 14. First bar 18 and second bar 20 are oriented parallel to each other. First bar 18 and second bar 20 are also oriented parallel to center support beam 16 and to longitudinal center axis X1. First bar 18 is located on a first side of center support beam 16 and second bar 20 is located on a second side of center support beam 16.

Exercise machine 10 further comprises a first handle bar assembly 22, a second handle bar assembly 24, a first foot block 26, and a second foot block 28. First handle bar assembly 22 and first foot block 26 are engaged with first bar 18. Second handle bar assembly 24 and second foot block 28 are engaged with second foot block 28. In particular, first handle bar assembly 22 and second handle bar assembly 24 are located proximate first end 10*c* of exercise machine. First foot block 26 and second foot block 28 are located longitudinally rearwardly from first end 10*c* of exercise machine and may be located proximate second end 10*d* thereof. Exercise machine 10 further includes front ground-engaging members 30 and rear ground-engaging members 32 that may be located on an underside of front track 12 and rear track 14. All of the aforementioned components will be described in greater detail hereafter.

Figure 3:
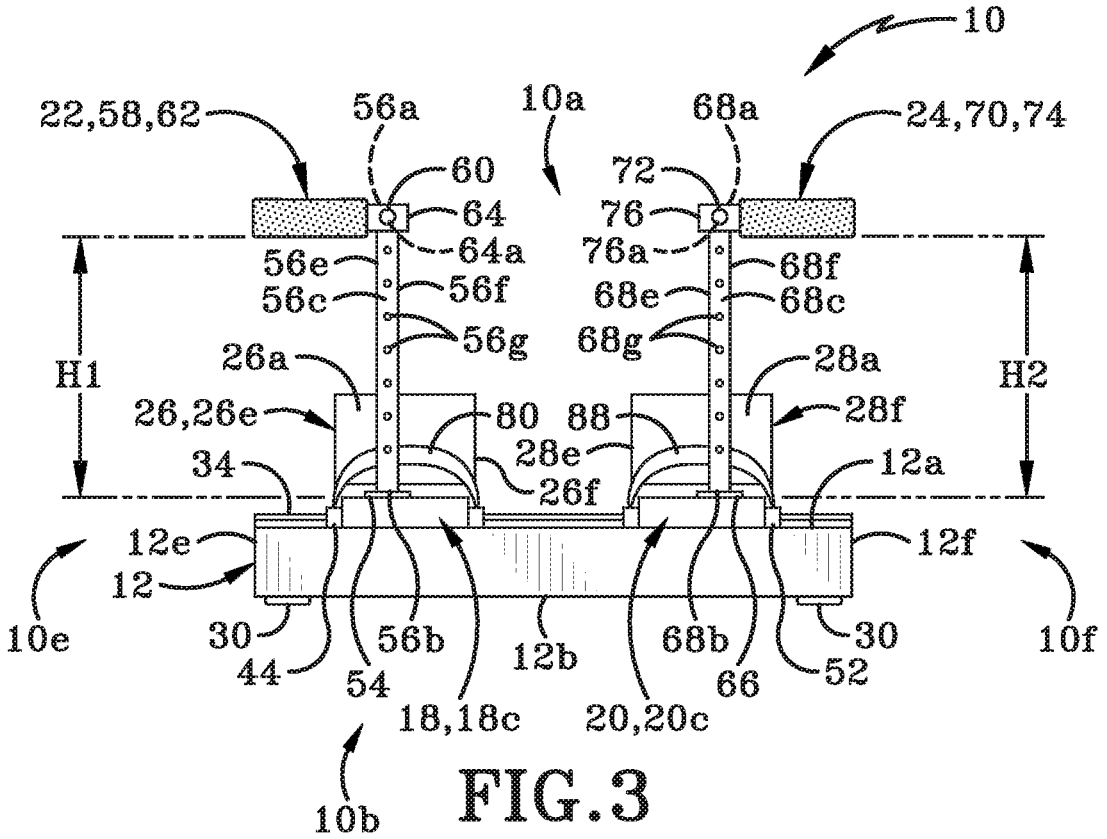
FIG. 3 is a first end view of the adjustable exercise machine of FIG. 1 showing the first handle assembly and second handle assembly in the same vertical positions relative to the first bar and the second bar.

With continued primary reference to FIG. 1 and FIG. 2, front track 12 includes a top 12*a*, a bottom 12*b*, a first end 12*c*, a second end 12*d*, a first side 12*e*, and a second side 12*f*. FIG. 3 shows that a pair of front ground-engaging members 30 extend downwardly from bottom 12*b* of front track 12 proximate first side 12*e* and second side 12*f*. It will be understood that more than the pair of front ground-engaging members 30 may be provided on front track 12 and that the front ground engaging members 30 may be positioned in different locations from what is illustrated in FIG. 3. A front insert 34 is provided on top 12*a* of front track 12 and extends upwardly therefrom. Front insert 34 is configured to engage first bar 18 and second bar 20 as more fully described below. FIG. 1 shows front insert 34 is T-shaped when viewed from either of the first side 12*e* or second side 12*f*. In one example, front insert 34 may be fabricated from a low-friction material. It will be understood in other examples, front insert 34 may be differently configured.

Figure 4:
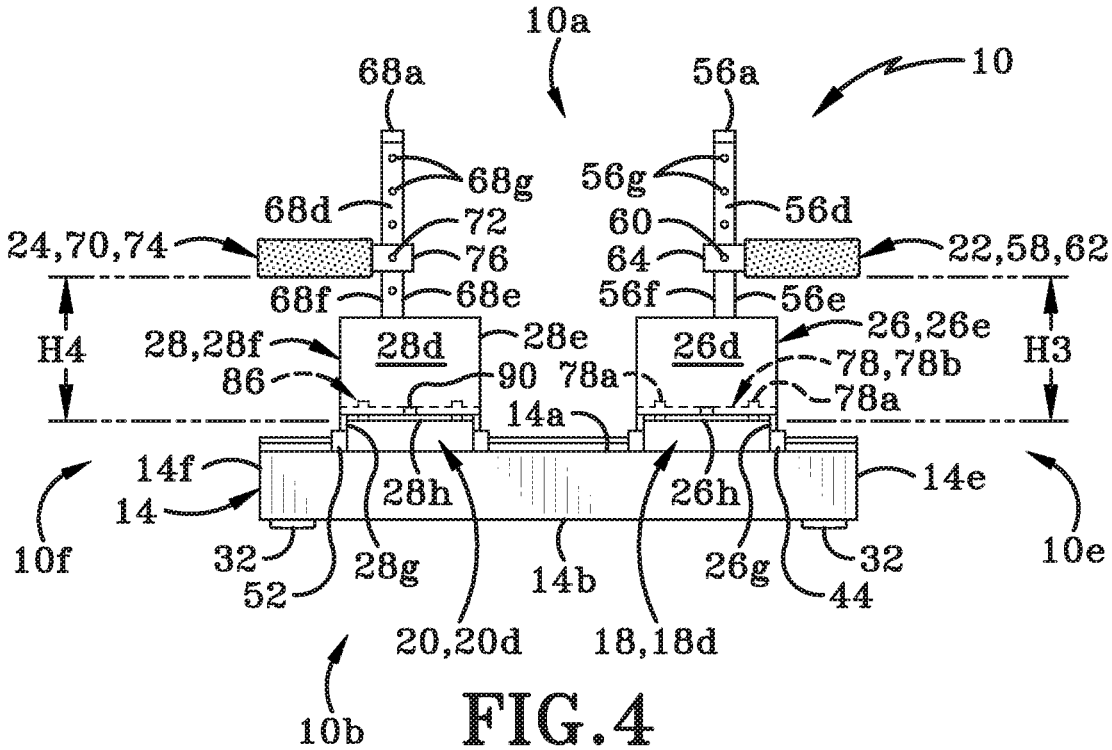
FIG. 4 is a second end view of the adjustable exercise machine of FIG. 1 showing the first handle assembly and the second handle assembly in a same vertical position relative to the first bar and the second bar that is different than the vertical position of the first handle bar assembly and the second handle bar assembly shown in FIG. 3.
Figure 5:
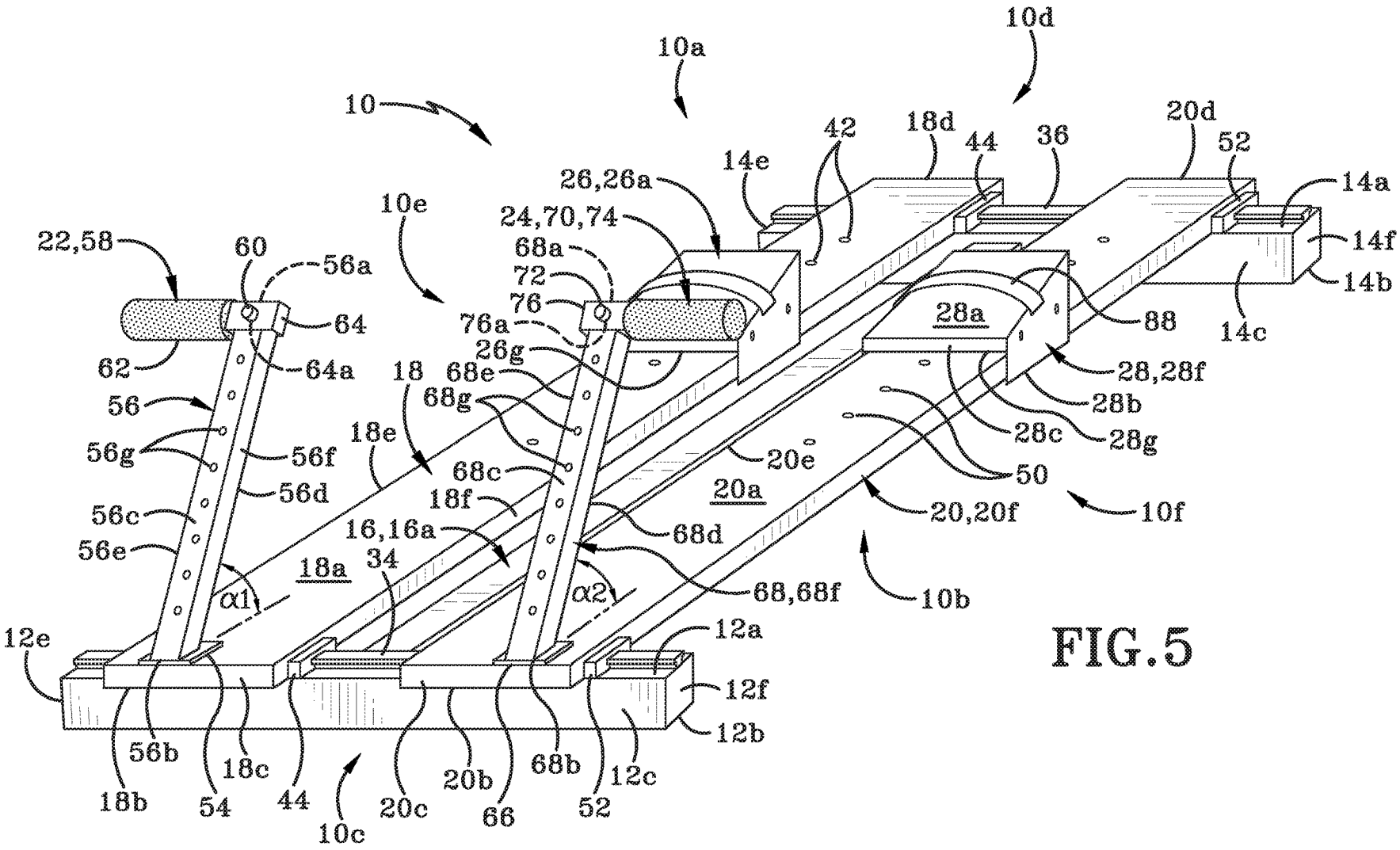
FIG. 5 is a perspective view of the adjustable exercise machine of FIG. 1.

With continued primary reference to FIG. 1 and FIG. 2, rear track 14 is provided a longitudinal distance rearwardly away from front track 12 and proximate second end 10*d* of exercise machine 10. Rear track 14 is generally coplanar with front track 12. Rear track 14 includes a top 14*a*, a bottom 14*b*, a first end 14*c*, a second end 14*d*, a first side 14*e*, and a second side 14*f*. FIG. 4 shows a pair of rear ground-engaging members 32 extend downwardly from bottom 14*b* of rear track 14 proximate first side 14*e* and second side 14*f*, It will be understood that more than the pair of rear ground-engaging members 32 may be provided on rear track 14 and that the rear ground engaging members 32 may be positioned in different locations from what is illustrated in FIG. 4. A rear insert 36 is provided on top 14*a* of rear track 14 and extends upwardly therefrom. Rear insert 36 is configured to engage first bar 18 and second bar 20 as more fully described below. As shown in FIG. 1, rear insert 36 is T-shaped when viewed from either of the first side 14*e* or second side 14*f*. In one example, insert 14 may be fabricated from a low-friction material. It will be understood in other examples, rear insert 36 may be differently configured.

With continued primary reference to FIG. 1 and FIG. 2, center support beam 16 includes a top 16*a*, a bottom 16*b*, a first end 16*c*, a second end 16*d*, a first side 16*e*, and a second side 16*f*. First end 16*c* of center support beam 16 is engaged with second end 12*d* of front track 12 and second end 16*d* of center support beam 16 is engaged with first end 14*c* of rear track 14. Center support beam 16 may be fixedly secured to front track 12 and rear track 14 in any suitable way, such as by welding the components to each other.

With continued primary reference to FIG. 1 and FIG. 2, first bar 18 is an elongated member that includes a top 18*a*, a bottom 18*b*, a first end 18*c*, a second end 18*d*, a first side 18*e*, and a second side 18*f*. When viewed from above, first bar 18 may be generally rectangular in shape. A front slot 38 is defined in bottom 18*b* of first bar 18 proximate first end 18*c* and a rear slot 40 is defined in bottom 18*b* of first bar 18 proximate second end 18*d*. Front slot 38 is configured to be substantially complementary to front insert 34 provided on front track 12 and is configured to receive front insert 34 therein. When front insert 34 is T-shaped, as shown in FIG. 1, front slot 38 is also T-shaped. If front insert 34 is differently configured, then front slot 38 will be similarly configured. Similarly, rear slot 40 is configured to be substantially complementary to rear insert 36 provided on rear track 14 and is configured to receive rear insert 36 therein. When rear insert 36 is T-shaped, as shown in FIG. 1, rear slot 40 is also T-shaped. If rear insert 36 is differently configured, then rear slot 40 will be similarly configured.

In one example, first bar 18 defines a plurality of through-holes 42 (FIG. 2) therein. Each hole 42 extends from top 18*a* of first bar 18 through to bottom 18*b* of first bar 18. Holes 42 are provided approximately midway between first side 18*e* and second side 18*f* of first bar 18 and generally from midway between first end 18*c* and second end 18*d* and extending rearwardly therefrom. Holes 42 may be arranged generally parallel to center axis X1 and may be spaced at regular intervals. The purpose of holes 42 will be later described herein.

First bar 18 is able to slide laterally along front track 12 and rear track 14, as indicated by arrow "A" in FIG. 2. In particular, first bar 18 is able to slide along the low friction inserts 34, 36 one of toward center support bar 16 and away from center support bar 16 and towards first ends 12*e*, 14*e*. Locking members 44 are provided on one or more of first bar 18, front track 12, and rear track 14. Locking members 44 are engageable to lock first bar 18 against lateral motion and are releasable to permit sliding lateral motion of first bar 18. Any suitable form of locking member 44 may be utilized for this purpose. FIG. 2 shows one of the plurality of locking members 44 provided proximate first side 18*e* of first bar 18 and engaging front track 12, one of the plurality of locking members 44 is provided proximate second side 18*f* of first bar 18 and engages front track 12, one of the plurality of 34*s* 44 is provided proximate first side 18*e* of first bar 18 and engages rear track 14, and one of the plurality of locking members 44 is provided proximate second side 18*f* of first bar 18 and engages rear track 14. As such, first bar 18 is selectively slidable in the transverse direction along front insert 34 and rear insert 36 and is held in a particular position and/or configuration via locking members 44 as more fully described below.

With continued primary reference to FIG. 1 and FIG. 2, second bar 20 includes a top 20*a*, a bottom 20*b*, a first end 20*c*, a second end 20*d*, a first side 20*e*, and a second side 20*f*. When viewed from above, second bar 20 may be generally rectangular in shape. A front slot 46 is defined in bottom 20*b* of second bar 20 proximate first end 20*c* and a rear slot 48 is defined in bottom 20*b* proximate second end 20*d*. Front slot 46 is configured to be substantially complementary to front insert 34 provided on front track 12 and is configured to receive front insert 34 therein. When front insert 34 is T-shaped, as shown in FIG. 1, front slot 46 is also T-shaped. If front insert 34 is differently configured, then front slot 46 will be similarly configured. Similarly, rear slot 48 is configured to be substantially complementary to rear insert 36 provided on rear track 14 and is configured to receive rear insert 36 therein. When rear insert 36 is T-shaped, as shown in FIG. 1, rear slot 48 is also T-shaped. If rear insert 36 is differently configured, then rear slot 48 will be similarly configured.

In one example, second bar 20 defines a plurality of through-holes 50 (FIG. 2) therein. Each hole 50 extends from top 20*a* through to bottom 20*b*. Holes 50 are provided approximately midway between first side 20*e* and second side 20*f* of second bar 20 and generally from midway between first end 20*c* and second end 20*d* and extending rearwardly therefrom. Holes 50 may be arranged generally parallel to center axis X1 and may be spaced at regular intervals. The purpose of holes 50 will be later described herein.

Second bar 20 is able to slide laterally along front track 12 and rear track 14, as indicated by arrow "A" in FIG. 2. In particular, second bar 20 is able to slide along the low friction inserts 34, 36 one of toward center support bar 16 and away from center support bar 16 and towards second ends 12*f*, 14*f*. Locking members 52 are provided on one or more of second bar 20, front track 12, and rear track 14. Locking members 52 are engageable to lock second bar 20 against lateral motion and are releasable to permit sliding lateral motion of second bar 20. Any suitable form of locking member 52 may be utilized for this purpose. FIG. 2 shows one of the plurality of locking members 52 provided proximate first side 20*e* of second bar 20 and engaging front track 12, one of the plurality of locking members 52 is provided proximate second side 20*f* of second bar 20 and engages front track 12, one of the plurality of locking members 52 is provided proximate first side 20*e* of second bar 20 and engages rear track 14, and one of the plurality of locking members 52 is provided proximate second side 20*f* of second bar 20 and engages rear track 14. As such, second bar 20 is selectively slidable in the transverse direction along front insert 34 and rear insert 36 and is held in a particular position and/or configuration via locking members 52 as more fully described below.

Figure 6:
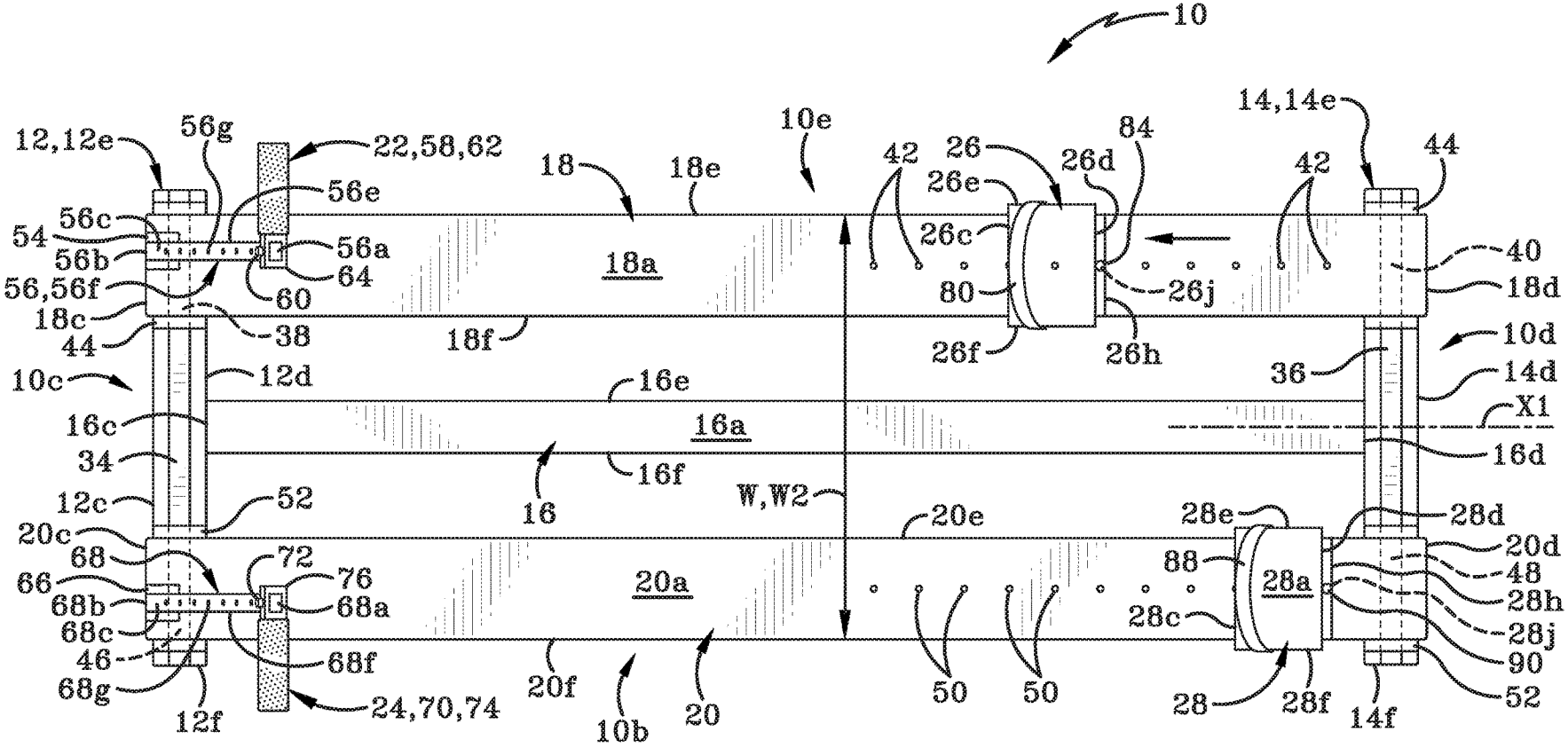
FIG. 6 is a top plan view of the adjustable exercise machine of FIG. 1 showing the first bar and second bar in a second position laterally relative to the center support beam; the first handle assembly and the second handle assembly in different positions relative to the first bar and the second bar; and further showing the first foot block and the second foot block in different positions longitudinally relative to the first end of the exercise machine.

As described above, first bar 18 is selectively slidable in the transverse direction along front insert 34 and rear insert 36 and is held in a particular position and/or configuration via locking members 44 and second bar 20 is selectively slidable in the transverse direction along front insert 34 and rear insert 36 and is held in a particular position and/or configuration via locking members 52 as more fully described below. Stated otherwise, first bar 18 and second bar 20 may be moved in transverse directions to vary the distance between first side 18*e* of first bar 18 and second side 20*f* of second bar 20 (or between second side 18*f* of first bar 18 and first side 20*e* of second bar 20). In one non-limiting example, and as shown in FIG. 2, first bar 18 is locked into a first position along front insert 34 and rear insert 36 and second bar 20 is locked into a first position along front insert 34 and rear insert 36 such that first side 18*e* of first bar 18 is positioned a first width W1 away from second side 20*f* of second bar 20. One or both of first bar 18 and second bar 20 may be moved laterally along front track 12 and rear track 14 to change the distance therebetween. In another non-limiting example, and as shown in FIG. 6, first bar 18 is locked into a second position along front insert 34 and rear insert 36 and second bar 20 is locked into a second position along front insert 34 and rear insert 36 such that first side 18*e* of first bar 18 is positioned a second width W2 away from second side 20*f* of second bar 20. Second width W2 is different from first width W1. As illustrated, second width W2 is greater than first width W1. Therefore, the width between first side 18*e* of first bar 18 and second side 20*f* of second bar 20 may be adjusted to-accommodate various sizes of users of exercise machine 10. In particular, the first bar 18 and second bar 20 may be moved to positions that are generally in alignment with the right and left shoulders of the person who will be using exercise machine.

As indicated earlier herein, exercise machine 10 includes a first handle bar assembly 22 provided on first bar 18 and a second handle bar assembly 24 provided on second bar 20. First handle bar assembly 22 and second handle bar assembly 24 are substantially identical with each other except the handles provided thereon extend outwardly in different directions. With primary reference to FIG. 2, first handle bar assembly 22 includes a mounting bracket 54 that secures the first handle bar assembly 22 to first bar 18, a support member 56, which may also be referred to as first support member, which extends upwardly and outwardly from mounting bracket 54, a handle member 58, and a locking pin 60. Support member 56 may be generally square in cross-section and includes a top 56*a*, a bottom 56*b*, a first end 56*c*, a second end 56*d*, a first side 56*e*, and a second side 56*f*. Mounting bracket 54 may be integral or fixedly engaged with bottom 56*b* of support member 56 and secures the same to top 18*a* of first bar 18 proximate first end 18*c*. Support member 56 angles upwardly and rearwardly from top 18*a* of first bar 18. Support member 56 may be oriented at an angle $\alpha_1$ (FIG. 5) relative to top 18*a* of first bar 18. In one example, the angle $\alpha_1$ is approximately sixty-five degrees; however the angle $\alpha_1$ may be any suitable angle.

Handle member 58 includes a gripping portion 62 and a mounting portion 64. Mounting portion 64 defines an aperture 64*a* (FIG. 2) sized to receive support member 56 therethrough. Mounting portion 64 further includes a pair of through-holes 64*b*. As shown in FIG. 3 and FIG. 4, a plurality of pairs of aligned through-holes 56*g* are provided on first and second ends 56*c*, 56*d* of support member 56. Handle member 58 may be moved upwardly or downwardly along support member 56 until handle member 58 is located at a desired distance from first bar 18. Through-holes 64*b* on handle member 58 are selectively aligned with one of the pairs of through-holes 56*g* on support member 56 and locking pin 60 is inserted through the aligned holes 64*b*, 56*g* to lock handle member 58 in the desired position. As such, handle member 58 may be selectively operably engaged with any of the pairs of through-holes 56*g* of support member 56.

With primary reference to FIG. 2, second handle bar assembly 24 includes a mounting bracket 66 that secures the second handle bar assembly 24 to second bar 20, a support member 68, which may also be referred to as second support member, that extends upwardly and outwardly from mounting bracket 66, a handle member 70, and a locking pin 72. Support member 68 may be generally square in cross-section and includes a top 68*a*, a bottom 68*b*, a first end 68*c*, a second end 68*d*, a first side 68*e*, and a second side 68*f*. Mounting bracket 66 may be integral or fixedly engaged with bottom 68*b* of support member 68 and secures the same to top 20*a* of second bar 20 proximate first end 20*c*. Support member 68 angles upwardly and rearwardly from top 20*a* of second bar 20. Support member 68 may be oriented at an angle $\alpha_2$ (FIG. 5) relative to top 20*a* of second bar 20. In one example, the angle $\alpha_2$ is approximately sixty-five degrees; however the angle $\alpha_2$ may be any suitable angle.

Handle member 70 includes a gripping portion 74 and a mounting portion 76. Mounting portion 76 defines an aperture 76*a* (FIG. 2) sized to receive support member 68 therethrough. Mounting portion 76 further includes a pair of through-holes 76*b*. As shown in FIG. 3 and FIG. 4, a plurality of pairs of aligned through-holes 68*g* are provided on first and second ends 68*c*, 68*d* of support member 68. Handle member 70 may be moved upwardly or downwardly along support member 68 until handle member 70 is located at a desired distance from second bar 20. Through-holes 70*b* on handle member 70 are selectively aligned with one of the pairs of through-holes 68*g* on support member 68 and locking pin 72 is inserted through the aligned holes 70*b*, 68*g* to lock handle member 70 in the desired position. As such, handle member 70 may be selectively operably engaged with any of the pairs of through-holes 68*g* of support member 68.

Handle member 58 and handle member 70 are individually selectively adjustable in height relative to top 18*a* of first bar 18 and top 20*a* of second bar 20, respectively. In one non-limiting example, and as shown in FIG. 3, handle member 58 is locked into a first position along support member 56 and handle member 70 is locked into a second position along support member 68. Handle member 58 is a first height H1 away from first bar 18 and handle member 70 is a second height H2 away from second bar 20, where second height H2 is the same as height H1. In another non-limiting example, and with reference to FIG. 4, handle member 58 is located at a height H3 away from first bar 18 and handle member 70 is located a fourth height H4 away from second bar 20, and height H4 is the same as height H3; however, height H3 and height H4 are at a different height than height H1 and height H2. The user may therefore customize their exercise machine 10 by selectively setting the height of each handle member 58 and 70 to suit them or to suit the type of core exercise, such as, for example, a plank exercise, which they wish to perform on exercise machine 10.

With primary reference to FIG. 1 and FIG. 2, first foot block 26 includes a top surface 26*a*, a bottom surface 26*b*, a first end surface 26*c*, a second end surface 26*d*, a first side surface 26*e*, and a second side surface 26*f*. Bottom surface 26*b* defines a U-shaped channel 26*g* that is sized to receive first bar 18 therein. First foot block 26 further includes a wheel assembly 78 that includes at least a pair of wheels 78*a* and an axle 78*b* which are located so as to run along top surface 18*a*. In other instances, wheel assembly 78 may include wheels that are positioned to run along first side 18*e* and second side 18*f* of first bar 18. A flange 26*h* extends rearwardly from second end surface 26*d*. Flange 26*h* is located so as to be proximate top 18*a* of first bar 18. A through-hole 26*i* is provided in flange 26*h* and is positioned so as to be selectively alignable with one of the holes 42 in first bar 18.

First foot block 26 further includes a strap 80 that is operably engaged with first side surface 26*e* and second side surface 26*f* of first foot block 26 and extends transversely from first side surface 26*e* to second side surface 26*f* of first foot block 26. Strap 80 may be selectively adjustable in length so that a user may be able to insert a right foot through strap 80 and onto top surface 26*a* of first foot block 26 and then tighten strap 80 to secure their foot in place. Top surface 26*a* angles downwardly and forwardly from a top of second end surface 26*d* at an angle $\alpha_3$. Angle $\alpha_3$ is approximately thirty-five degrees; however the angle $\alpha_3$ may be any suitable angle.

First foot block 26 is selectively operably engaged with first bar 18 by aligning through-hole 26*i* of flange 26*h* with one of the plurality of through-holes 42 of first bar 18 and inserting a locking device 84 therethrough. The user may customize exercise machine 10 by selectively moving first foot block 26 to a desired position on first bar 18 that is suitable for that particular user. When the desired position is reached, locking device 84 is engaged through the aligned holes 26*i*, 42.

With primary reference to FIG. 1 and FIG. 2, second foot block 28 includes a top surface 28*a*, a bottom surface 28*b*, a first end surface 28*c*, a second end surface 28*d*, a first side surface 28*e*, and a second side surface 28*f*. Bottom surface 28*b* defines a U-shaped channel 28*g* that is sized to receive second bar 20 therein. Second foot block 28 further includes a wheel assembly 86 that includes at least a pair of wheels 86*a* and an axle 86*b* which are located so as to run along top surface 20*a*. In other instances, wheel assembly 86 may include wheels that are positioned to run along first side 20*e* and second side 20*f* of first bar. A flange 28*h* extends rearwardly from second end surface 28*d*. Flange 28*h* is located so as to be proximate top 20*a* of second bar 20. A through-hole 28*i* is provided in flange 28*h* and is positioned so as to be selectively alignable with one of the holes 50 in second bar 20.

Second foot block 28 further includes a strap 88 that is operably engaged with first side surface 28*e* and second side surface 28*f* of second foot block 28 and extends transversely from first side surface 28*e* to second side surface 28*f* of second foot block 28. Strap 88 may be selectively adjustable in length so that a user may be able to insert a left foot through strap 88 and onto top surface 28*a* of second foot block 28 and then tighten strap 88 to secure their foot in place. Top surface 28*a* angles downwardly and forwardly from a top of second end surface 28*d* at the same angle $\alpha_3$ as top surface 26*a* of first foot block 26.

Second foot block 28 is selectively operably engaged with second bar 20 by aligning through-hole 28*i* of flange 28*h* with one of the plurality of through-holes 50 of second bar 20 and inserting a locking device 90 therethrough. The user may customize exercise machine 10 by selectively moving second foot block 28 to a desired position on second bar 20 that is suitable for that particular user. When the desired position is reached, locking device 90 is engaged through the aligned holes 28*i*, 50.

As described above, first foot block 26 is selectively operably engaged with top 18*a* of first bar 18 via locking device 84 by aligning through-hole 26*i* of flange 26*h* with one of the plurality of through-holes 42 of first bar 18 and inserting locking device 84 therethrough. Second foot block 28 is selectively operably engaged with top 20*a* of second bar 20 via flange 28*h* by aligning through-hole 28*i* of flange 28*h* with one of the plurality of through-holes 50 of second bar 20 and inserting locking device 90 therethrough. Stated otherwise, first foot block 26 and second foot block 28 are selectively adjustable so as to be located at various distances from second end 18*d* of second bar 20 and second end 20*d* of second bar 20, respectively. In one non-limiting example, and as shown in FIG. 2, first foot block 26 is locked at a first position along top 18*a* of first bar 18 and second foot block 28 is locked at a second position along top 20*a* of second bar 20. Locking device 84 of first foot block 26 is located a first distance D1 away from second end 18*d* of first bar 18 and locking device 90 of second foot block 28 is located at a second distance D2 away from second end 20*d* of second bar 20. In this example, the first distance D1 is equal to the second distance D2. In another non-limiting example, and with reference to FIG. 6, first foot block 26 is locked at a third position along top 18*a* of first bar 18 and second foot block 28 is locked at the fourth position along top 20*a* of second bar 20. In particular, locking device 84 of first foot block 26 is located a third distance D3 away from second end 18*d* of first bar 18 and locking device 90 of second foot block 28 is located at a fourth distance D4 away from second end 20*d* of second bar 20. The distance D3 is greater than the distance D4. Therefore, the distances of locking device 84 of first foot block 26 from second end 18*d* of first arm 18 and locking device 90 of second foot block 28 from second end 20*d* of second arm 20 may be adjusted to accommodate various users of various heights as well as variations of core exercises.

It will be understood that front track 12, rear track 14, first bar 18, second bar 20, and center support beam 16 are all fabricated from materials that will permit exercise machine 10 to be strong enough to hold the full bodyweight of a user thereon. In one example, the materials selected for the various components of exercise machine 10 will be strong but also light enough for a user to carry the equipment from one location to another, i.e., the exercise machine 10 may be portable and may be suitable for use in a user's home. In another example, the materials selected for the various components may make the exercise machine too heavy to be carried. In this latter instance, the exercise machine 10 may be suitable for use in a commercial gym.

Although the first bar 18 and the second bar 20 have been described as being selectively individually adjustable, it is to be entirely understood that in other embodiments, the first bar 18 and the second bar 20 may be operatively linked with each other in some manner that will cause them to be adjusted in synchrony. In other words, if the first bar 18 is moved in either of a first direction or a second direction laterally with respect to center support beam 16, the second bar 20, which is linked to the first bar 18 in some suitable manner, will automatically move in the opposite direction. For example, if the first bar 18 moves laterally outwardly toward first side 12*e* then second bar 20 will move laterally outwardly toward second side 12*f*. If first bar 18 is moved laterally inwardly toward center support beam 16, then second bar 10 will move laterally inwardly toward center support beam 16.

Furthermore, although the first handle bar assembly 22 and the second handle bar assembly 24 have been described as being selectively individually adjustable, it is to be entirely understood that in other embodiments the first handle bar assembly 22 and second handle bar assembly 24 may be operatively linked with each other in some manner that will cause them to be adjusted in synchrony. For example, if the first handle bar assembly 22 is moved downwardly toward the first bar 18 then the second handle bar assembly 24 will automatically move downwardly toward the second bar 20 and to the same degree as first handle bar assembly 22. If the first handle bar assembly 22 is moved upwardly away from the first bar 18, then the second handle bar assembly 24 will automatically move upwardly away from the second bar 20 and to the same degree as the first handle bar assembly 22. The same type of movements will occur if second handle bar assembly 24 is selected for adjustment.

Additionally, although the first foot block 26 and the second foot block 28 have been described as being selectively individually adjustable, it is to be entirely understood that in other embodiments, the first foot block 26 and the second foot block 28 may be operatively linked with each other in some manner that will cause them to be adjusted in synchrony. For example, if the first foot block 26 is moved longitudinally forwardly toward front track 12, the second foot block 28 will automatically move longitudinally forwardly toward front track 12 and to the same degree as first foot block 26. If the first foot block 26 is moved longitudinally rearwardly toward rear track 14, the second foot block 28 will automatically move longitudinally forwardly toward front track 12 and to the same degree as first foot block 26. The same type of movements will occur if second foot block 28 is selected for adjustment.

Exercise machine 10 may further be provided with a first switching mechanism that enables a user to select whether to adjust the first bar 18 and second bar 20 individually or in synchrony. Exercise machine 10 may further be provided with a second switching mechanism that enables a user to select whether to adjust the first handle bar assembly 22 and second handle bar assembly 24 individually or in synchrony. Exercise machine 10 may further be provided with a third switching mechanism that enables a user to select whether to adjust the first foot block 26 and second foot block 28 individually or in synchrony. The first, second and third switching mechanisms may be provided as a control on the exercise machine 10.

Figure 7:
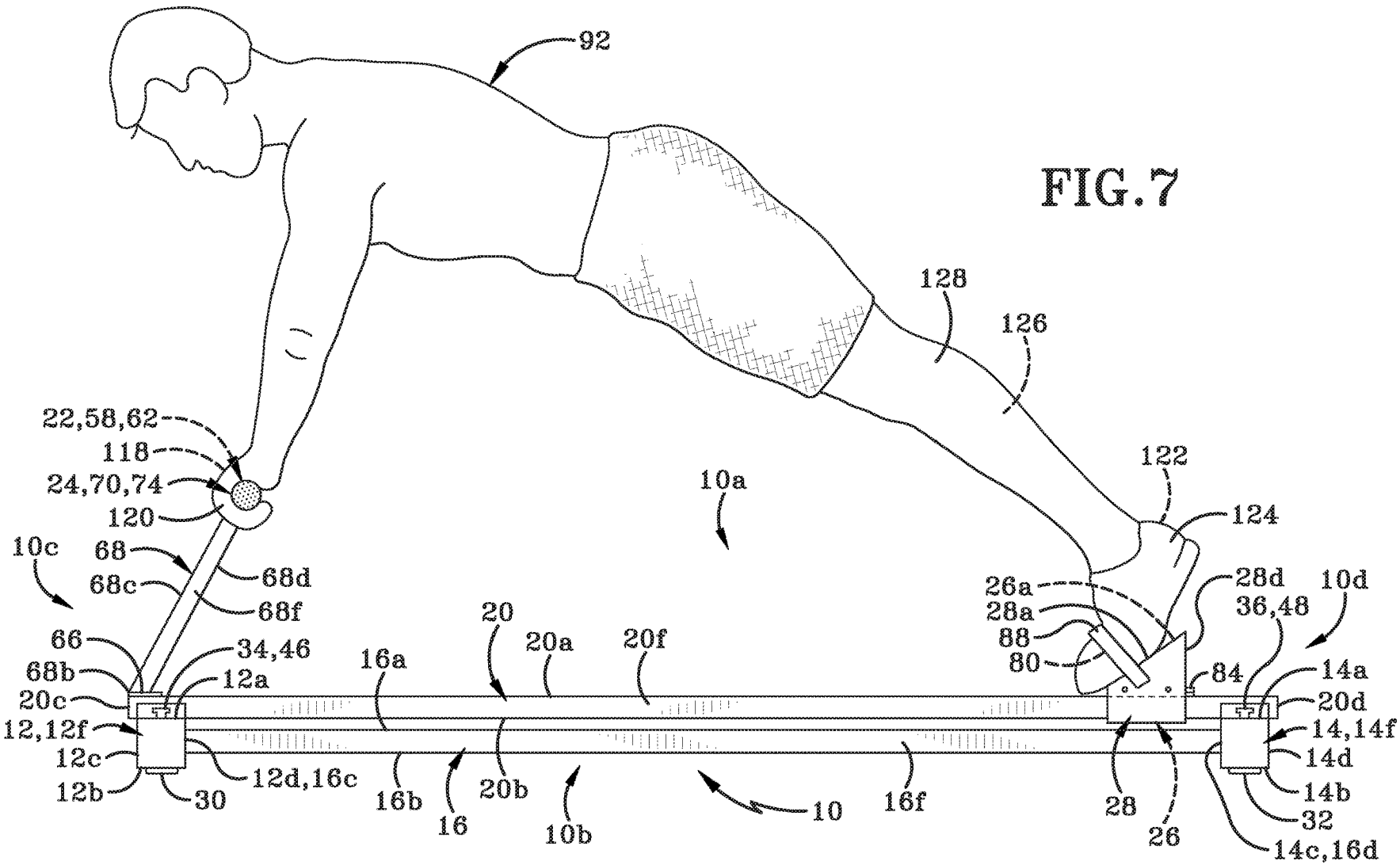
FIG. 7 is a side elevation view of a user utilizing the adjustable exercise machine of FIG. 1 to assist in the performance of a first core exercise in accordance with one aspect of the present disclosure.
Figure 8:
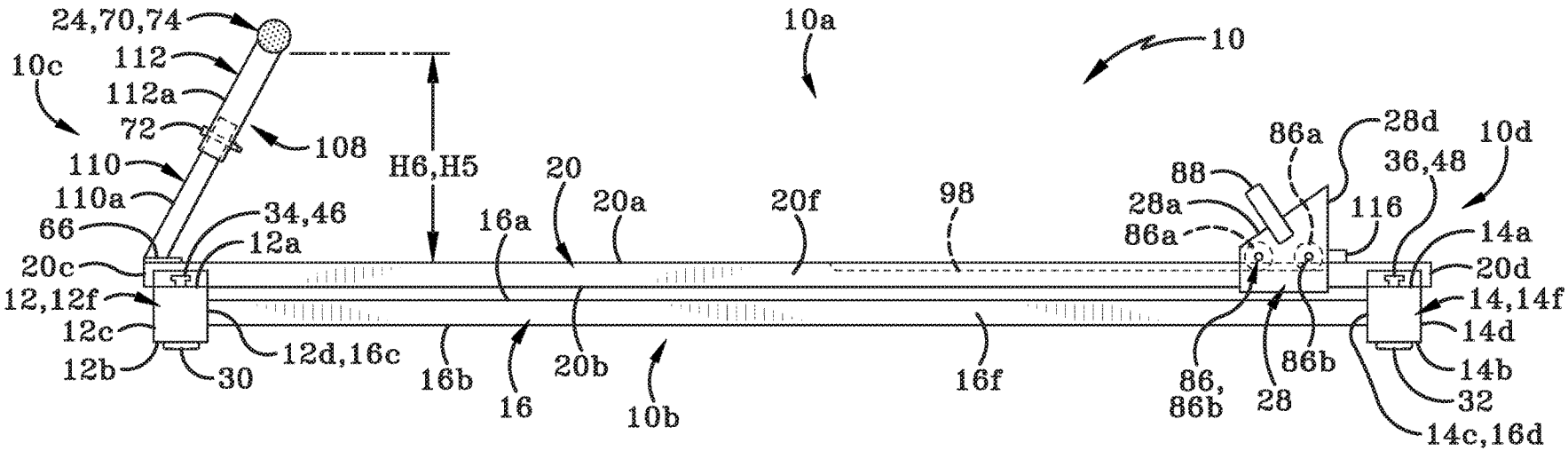
FIG. 8 is a side elevation view of a second embodiment of an adjustable exercise machine in accordance with one aspect of the present disclosure.

In operation, and with primary reference to FIG. 7, a user 92 may utilize the adjustable exercise machine 10 in the performance of a core exercise, such as, for example, a plank exercise. User 92 may adjust the exercise machine 10 to suit their body or to suit the type of core exercise that they wish to perform on exercise machine 10. For example, and not meant as a limitation, the user 92 may move one or both of first bar 18 and second bar 20 laterally along front track 12 and rear track 14 to change the lateral distance therebetween. In one example, the first bar 18 and second bar 20 may be moved to positions that are generally in alignment with the right and left shoulders of the user 92 who will be using exercise machine; however, other configurations are entirely possible. So, for example, the user may set the first bar 18 and second bar 20 so that they are at the first width W1 shown in FIG. 2 or they may set the first bar and second bar 20 at the second width W2 shown in FIG. 6.

The user 92 may further adjust the exercise machine 10 by selectively setting the height of each handle member 58 and 70 to suit their body or to suit the type of core exercise that they wish to perform on exercise machine 10. In one example, each handle member 58 and 70 may be set to the same height (as shown in FIG. 4); however, other configurations are entirely possible. For example, the handle member 58 may be set at a height H1 and the handle member 78 may be set at a height H3 as shown in FIG. 4.

The user 92 may further adjust the exercise machine 10 by selectively setting the first foot block 26 at a first position along top 18*a* of first bar 18 with locking device 84 and second foot block 28 at a second position along top 20*a* of second bar 20 with locking device 90. In one example, the distances of locking device 84 of first foot block 26 from second end 18*d* of first arm 18 and locking device 90 of second foot block 28 from second end 20*d* of second arm 20 are the same distances, i.e., D1 (see FIG. 2); however, other configurations are entirely possible. FIG. 6, for example, shows first foot block 26 at a distance D2 and second foot block 26 at the distance D1. As such, the adjustable exercise machine 10 may be adjusted to accommodate various differently shaped and sized users as well as accommodate variations of core exercises.

FIG. 8 through FIG. 11B show a second embodiment of an adjustable exercise machine in accordance with an aspect of the present disclosure, generally depicted at 200. Exercise machine 200 is configured to assist a user in the performance of a core exercise. Exercise machine 200 is substantially identical to exercise machine 10 of FIG. 1 through FIG. 6 in structure and function with a few exceptions/additions that will be discussed hereafter in greater detail.

Figure 9:
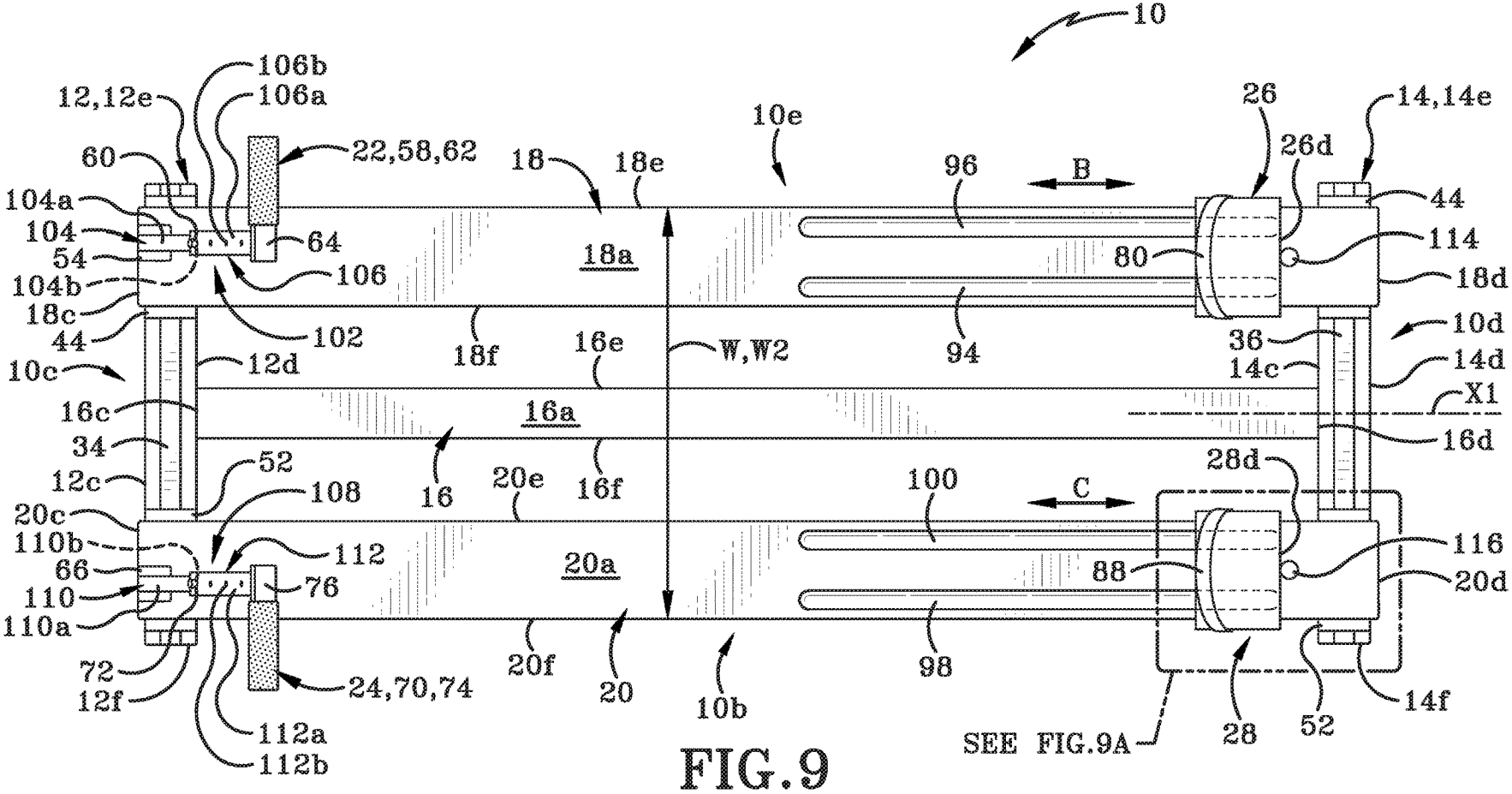
FIG. 9 is a top plan view of the adjustable exercise machine of FIG. 8 showing the first bar and second bar in a second position laterally relative to the center support beam; the first handle assembly and the second handle assembly in the same positions relative to the first bar and the second bar; and further showing the first foot block and the second foot block in the same positions longitudinally relative to the first end of the exercise machine.

With primary reference to FIG. 9, first bar 18 of exercise machine 200 is different than first bar 18 of exercise machine 10. More particularly, first bar 18 of exercise machine 200 includes a first groove 94 and a second groove 96 defined in top 18*a* of first bar 18. First groove 94 is provided proximate second side 18*f* of first bar 18 and between first end 18*c* and second end 18*d* and extending rearwardly therefrom. Second groove 96 is provided proximate second side 18*f* of first bar 18 and between first end 18*c* and second end 18*d* and extending rearwardly therefrom. First groove 94 is spaced transversely a distance away from second groove 96.

With primary reference to FIG. 9, second bar 20 of exercise machine 200 is different than second bar 20 of exercise machine 10. More particularly, second bar 20 of exercise machine 200 includes a first groove 98 and a second groove 100 defined in top 20*a* of second bar 20. First groove 98 is provided proximate second side 20*f* of second bar 20 and between first end 20*c* and second end 20*d* and extending rearwardly therefrom. Second groove 100 is provided proximate second side 20*f* of second bar 20 and between first end 20*c* and second end 20*d* and extending rearwardly therefrom. First groove 98 is spaced transversely a distance away from second groove 96.

First handle bar assembly 22 of exercise machine 200 is different than first handle bar assembly 22 of exercise machine 10. More particularly, first handle bar assembly 22 of exercise machine 200 includes a first support member 102 that is different than first support member 56 of first handle bar assembly 22 of exercise machine 10. Additionally, handle member 58 of exercise machine 200 is operably engaged with first support member 102 in a different manner than that in which handle member 58 is operably engaged with support member 56. First support member 102 includes a first section 104 and a second section 106. First section 104 of first support member 102 includes a first end 104*a* that defines a through-hole 104*b* (FIG. 9) therein. Second section 106 of first support member 102 includes a first end 106*a* that defines a plurality of through-holes 106*b* (FIG. 9) therein. First section 104 and second section 106 are configured to telescope relative to each other as more fully described below. Second section 106 is selectively operably engaged with first section 104 via locking pin 60 by aligning one of the plurality of through-holes 104*b* of first section 104 with one of the plurality of through-holes 106*b* of second section 106 and inserting locking pin 60 therethrough. As such, first section 104 may be telescoped in a first direction to decrease the overall length of first section 104 and second section 106 or first section 104 may be telescoped in a second direction to increase the overall length of first section 104 and the second section 106. The change in overall length of first section 104 and second section 106 decreases or increases the height of the first handle member 58 relative to first bar 18. Locking pin 60 may be utilized to selectively lock the telescoping first section 104 and second section 106 against further telescoping movement so that the exercise machine 200 may be used. Mounting portion of handle member 58 is operably engaged with second section 106 such as, for example, via welding; however, mounting portion 64 may be operably engaged with second section 106 in any other suitable manner. As such, handle member 58 moves in conjunction with the telescoping movement of the second section 106 and handle member 58 may be set to a fifth height H5 away from first bar 18.

Second handle bar assembly 24 of exercise machine 200 is different than second handle bar assembly 24 of exercise machine 10. More particularly, second handle bar assembly 24 of exercise machine 200 includes a second support member 108 that is different than second support member 68 of second handle bar assembly 24 of exercise machine 10 and handle member 70 of exercise machine 200 is operably engaged with second support member 108 in a different manner than handle member 70 is operably engage with support member 68. Second support member 108 includes a first section 110 and a second section 112. First section 110 of second support member 108 includes a first end 110*a* that defines a plurality of through-holes 110*b* (FIG. 9) therein. Second section 112 of second support member 108 includes a first end 112*a* that defines a plurality of through-holes 112*b* (FIG. 9) therein. First section 110 and second section 112 are configured to telescope relative to each other as more fully described below. Second section 112 is selectively operably engaged with first section 110 via locking pin 72 by aligning one of the plurality of through-holes 110*b* of first section 110 with one of the plurality of through-holes 112*b* of second section 112 and inserting locking pin 72 therethrough. As such, first section 110 may be telescoped in a first direction to decrease the overall length of first section 110 and second section 112 or may be telescoped in a second direction to increase the overall length of first section 110 and the second section 112. The change in overall length of first section 110 and second section 112 decreases or increases the height of the second handle member 70 relative to second bar 20. Locking pin 72 may be utilized to selectively lock the telescoping first section 110 and second section 112 against further telescoping movement so that the exercise machine 200 may be used. Mounting portion 76 of handle member 70 is operably engaged with second section 112 such as, for example, via welding; however, mounting portion 76 may be operably engaged with second section 112 in any suitable manner. As such, handle member 70 moves in conjunction with the telescoping movement of the second section 112 and handle member 70 may be set to a sixth height H6 away from second bar 20.

Figure 9A:
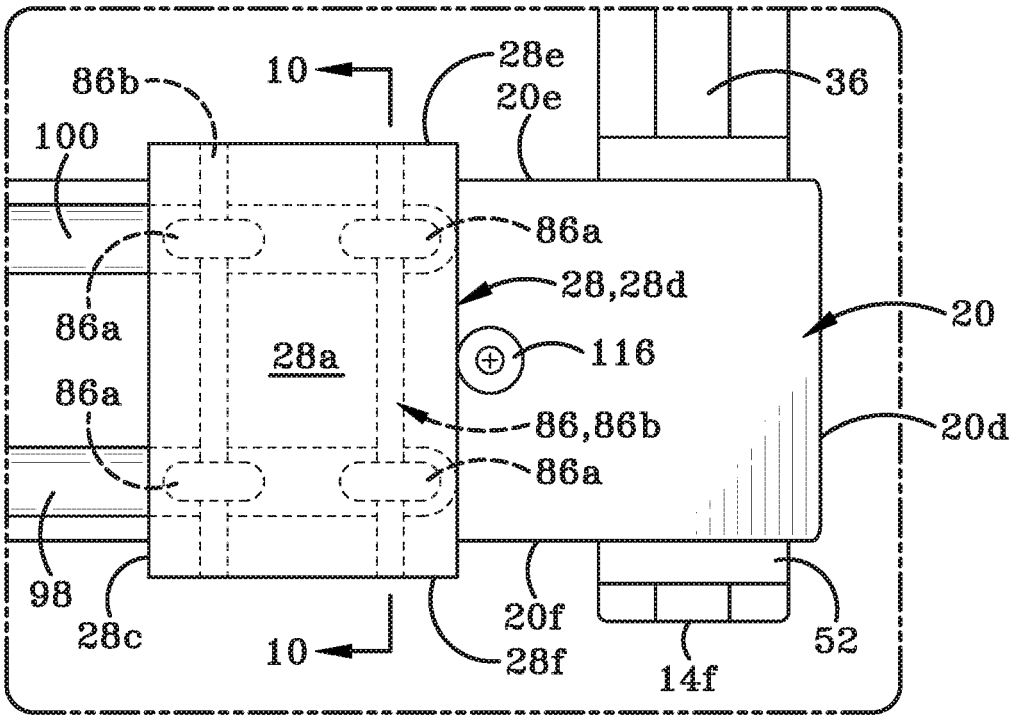
FIG. 9A is an enlarged fragmentary view of a portion of the adjustable exercise machine of FIG. 9 highlighted by the dashed box labeled SEE FIG. 9A, with a strap removed.
Figure 10:
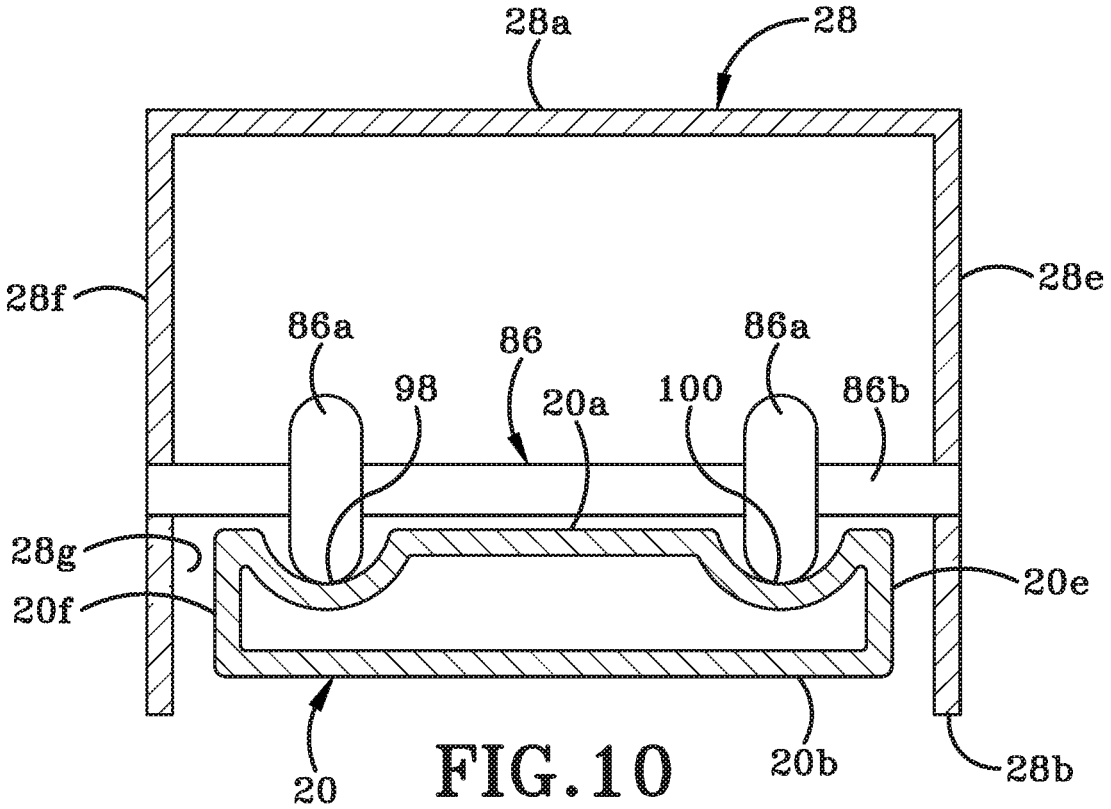
FIG. 10 is a cross section taken along line 10-10 of FIG. 9A view of the portion of the adjustable exercise machine of FIG. 9.

With primary reference to FIG. 9, FIG. 9A, and FIG. 10, first foot block 26 of exercise machine 200 is different than first foot block 26 of exercise machine 10. Further, first foot block 26 of exercise machine 200 is operably engaged with first bar 18 of exercise machine 200 in a different manner than the manner in which first foot block 26 of exercise machine 10 is operably engaged with first bar 18 of exercise machine 10. More particularly, first foot block 26 includes a top surface 26*a*, a bottom surface 26*b*, a first end surface 26*c*, a second end surface 26*d*, a first side wall 26*e*, and a second side wall 26*f*. Bottom surface 26*b* defines a U-shaped channel (not shown) that is sized to receive first bar 18 therein. Wheel assembly 78 includes at least a pair of wheels 78*a* and an axle 78*b* which are located so as to run along the first groove 94 and the second groove 96 of first bar 18 as indicated by arrow "B" in FIG. 9 as more fully described below. As shown in FIG. 9, exercise machine 200 further includes a bumper 114 which aids in preventing movement of the first foot block 26 out of the first groove 94 and second groove 96 in the longitudinal direction towards the second end 18*d* of first bar 18.

With primary reference to FIG. 9, FIG. 9A, and FIG. 10, second foot block 28 of exercise machine 200 is different than second foot block 28 of exercise machine 10. Further, second foot block 28 of exercise machine 200 is operably engaged with second bar 20 of exercise machine 200 in a different manner than the manner in which second foot block 28 of exercise machine 10 is operably engaged with second bar 20 of exercise machine 10. More particularly, second foot block 28 includes a top surface 28*a*, a bottom surface 28*b*, a first end surface 28*c*, a second end surface 28*d*, a first side wall 28*e*, and a second side wall 28*f*. Bottom surface 26*b* defines a U-shaped channel 28*g* that is sized to receive second bar 20 therein. Wheel assembly 86 includes at least a pair of wheels 86*a* and an axle 86*b* which are located so as to run along the first groove 98 and the second groove 100 of second bar 20 as indicated by arrow "C" in FIG. 9 as more fully described below. As shown in FIG. 9, exercise machine 200 further includes a bumper 116 which aids in preventing movement of the second foot block 28 out of the first groove 98 and second groove 100 in the longitudinal direction towards the second end 20*d* of second bar 20.

Figure 11A:
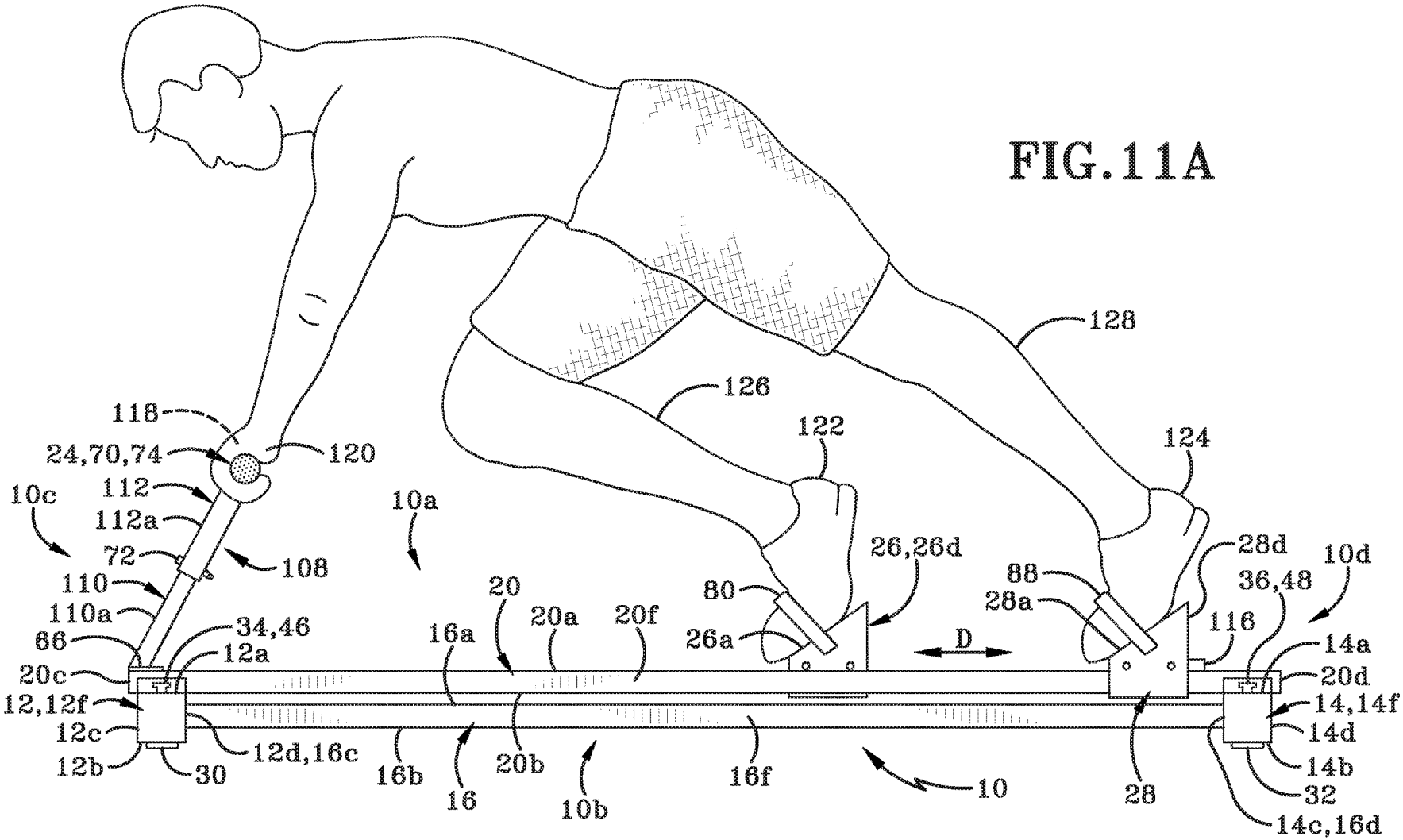
FIG. 11A is a side elevation view showing a user utilizing the adjustable exercise machine to assist in the performance of a second core exercise in accordance with one aspect of the present disclosure.
Figure 11B:
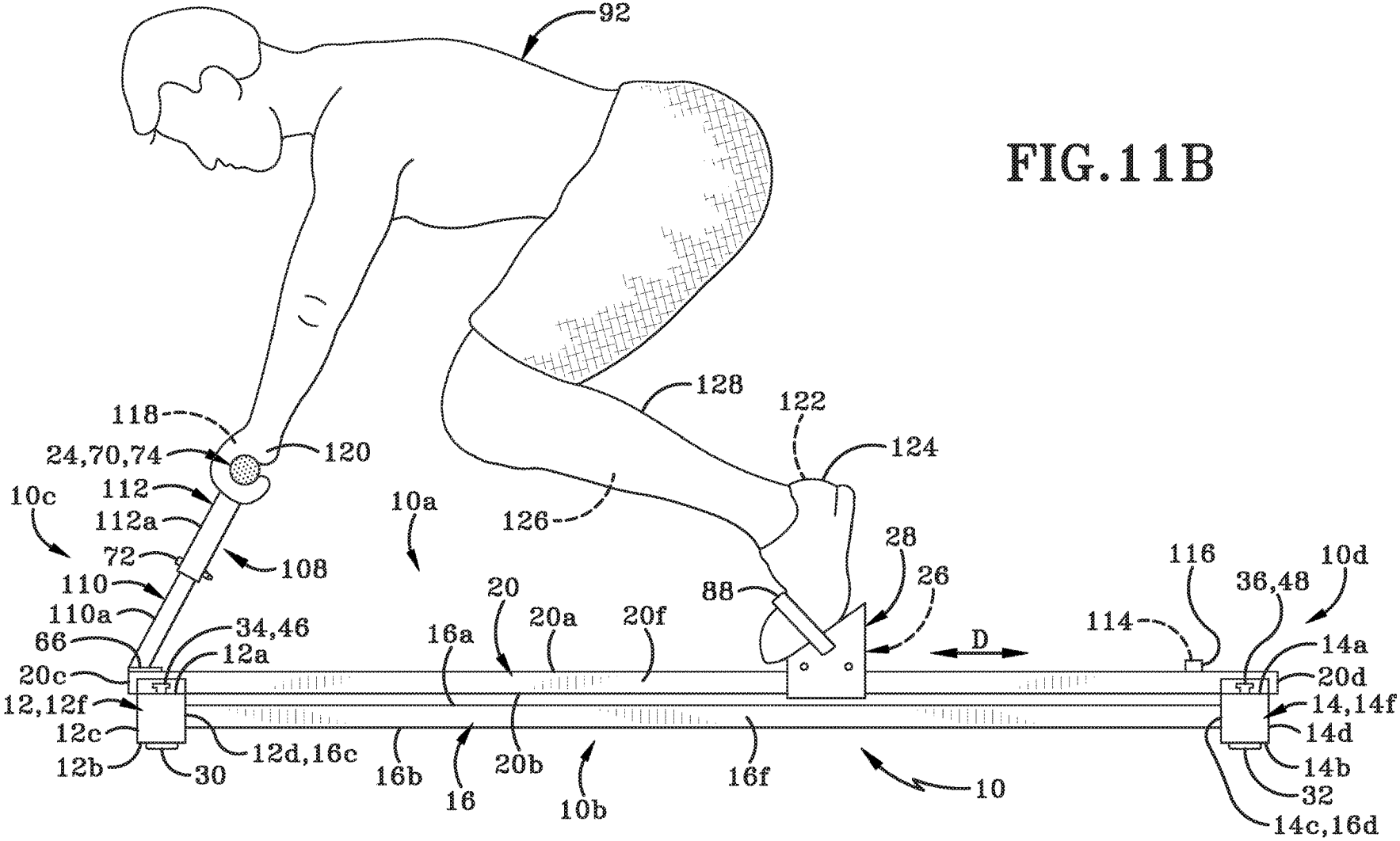
FIG. 11B is a side elevation view showing a user utilizing the adjustable exercise machine to assist in the performance of a third core exercise in accordance with one aspect of the present disclosure.

In operation, and with primary reference to FIG. 11A and FIG. 11B, a user 92 may utilize the adjustable exercise machine 200 in the performance of a core exercise. In this embodiment, the core exercise that is illustrated as being able to be performed on exercise machine 200. User 92 may adjust the exercise machine 200 to suit their body or to suit the type of core exercise that they wish to perform on exercise machine 200. For example, and not meant as a limitation, the user 92 may move one or both of first bar 18 and second bar 20 laterally along front track 12 and rear track 14 to change the lateral distance therebetween. In one example, the first bar 18 and second bar 20 may be moved to positions that are generally in alignment with the right and left shoulders of the user 92 who will be using exercise machine; however, other configurations are entirely possible. So, for example, the user 92 may set the first bar 18 and second bar 20 so that they are at the second width W2 as shown in FIG. 9, which is the same as the second width as shown in FIG. 6.

The user 92 may further adjust the exercise machine 10 by selectively setting the height of each handle member 58 and 70 to suit their body or to suit the type of core exercise that they wish to perform on exercise machine 10. In one example, each handle member 58 and 70 may be set to the same height (i.e., the fifth height H5 and the sixth height H6 as shown in FIG. 9) via the telescoping movement described above; however, other configurations are entirely possible. For example, the handle member 58 may be set at a different height than a height of the second handle member 78.

Figure 12:
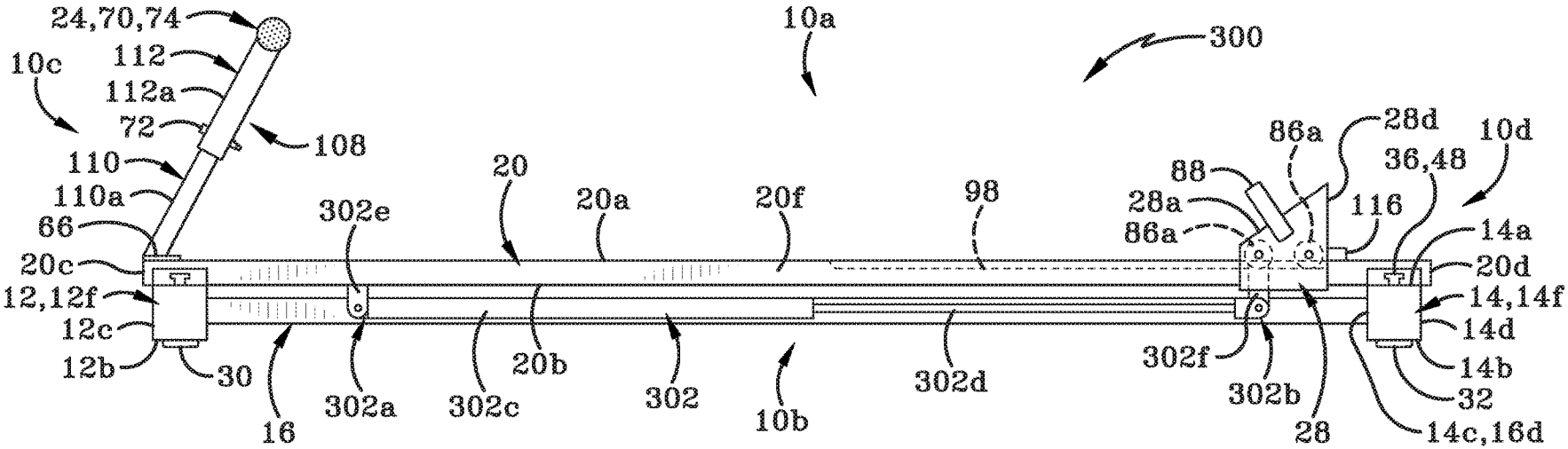
FIG. 12 is a side elevation view of a third embodiment of an adjustable exercise machine in accordance with one aspect of the present disclosure.

Referring to FIG. 12-FIG. 15, a third embodiment 300 of an adjustable exercise machine in accordance with one aspect of the present disclosure. Referring specifically to FIG. 12, a side elevation view of the third embodiment 300 of an adjustable exercise machine is shown. The third embodiment 300 is relatively similar to the first embodiment 10 and the second embodiment 200 with the main difference in that the third embodiment 300 contains further pieces, namely at least one piston 302. The at least one piston 302 includes a first end 302*a* and a second end 302*b* that is transversely opposed to the first end 302*a*. The first end 302*a* is towards the front end 10*c* and the second end 302*b* is toward the back end 10*d*. The at least one piston 302 further includes a cylinder body 302*c* and a piston rod 302*d*.

The cylinder body 302*c* is attached to the bottom 10*b* of the third embodiment 300 exercise machine by an attachment 302*e*. Further the piston rod 302*d* of the piston 302 is attached via an attachment arm 302*f* that terminates in the body of the respective foot 26, 28. As shown in this view, the piston 302 is in its extended position. In this embodiment there are two pistons 302, but in other embodiments there may be additional pistons depending on the resistance desired to be obtained as will be discussed later with respect to operation.

Figure 13:
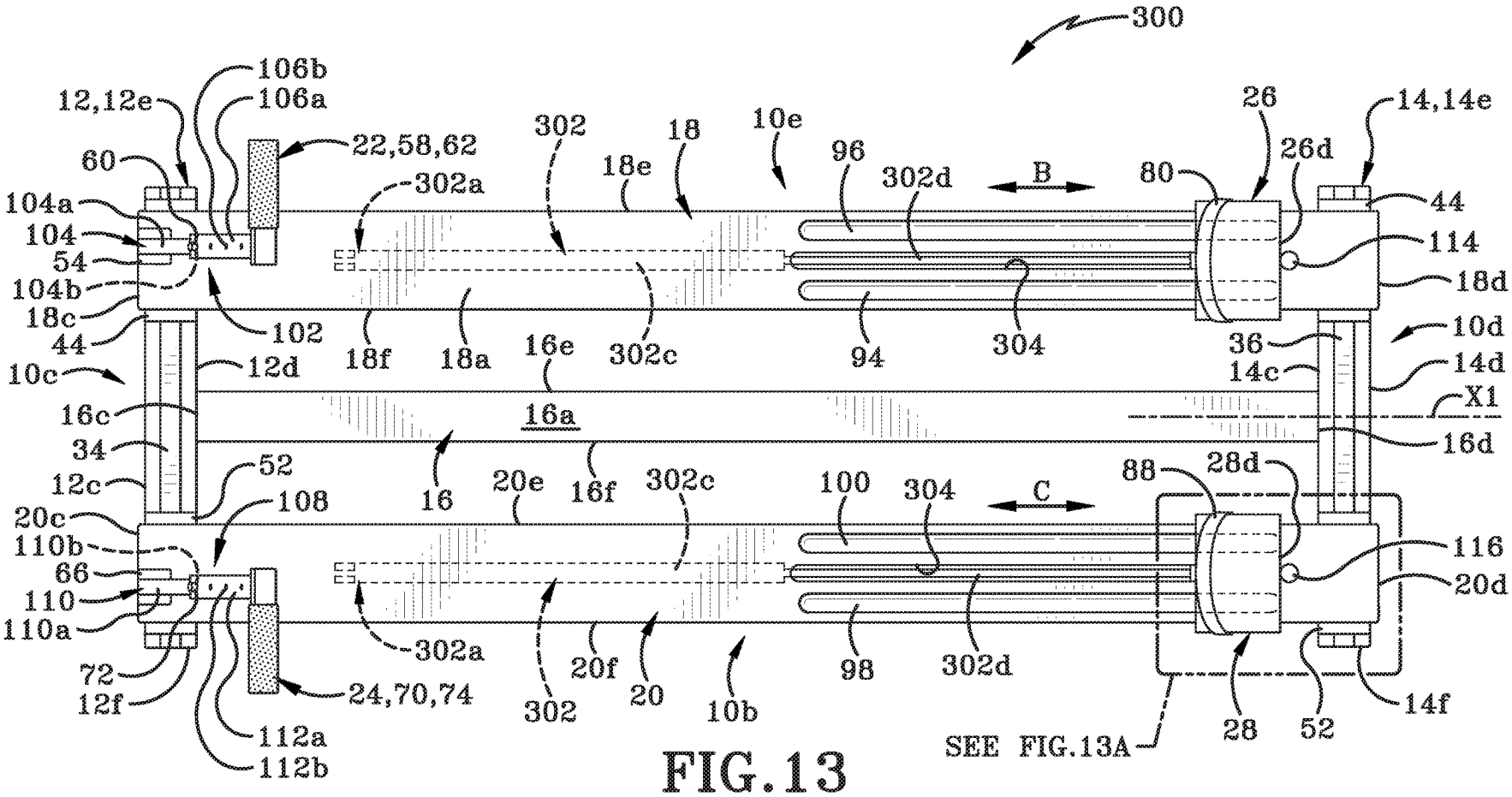
FIG. 13 is top plan view of the third embodiment of the adjustable exercise machine of FIG. 12 showing a first bar and a second bar in a first position laterally relative to a center support beam; a first handle assembly and a second handle assembly in a same position vertically relative to the first bar and second bar; and a first foot block and second foot block in a same position longitudinally relative to a first end of the exercise machine.

Referring specifically to FIG. 13, a top plan view of the third embodiment 300 of the adjustable exercise machine of FIG. 12 is shown. In this embodiment is similar to that of FIG. 2, with the exception that the at least one piston 302 is shown in its extended position with the respective foot block 26, 28 in a fully extended position. In a further contemplated embodiment, the at least one piston 302 may be placed in a reverse way, meaning that the first end 302*a* would have the attachment arm 302*f* that would attach to the respective foot block leading the cylinder body to be proximate the second end 10*d* and where the second end 302*b* would have an attachment of the piston rod 302*d* to the machine 300 proximate the first end 10*c*. Put simply, the piston rod 302 could be reversed relative to the body of the machine 300.

Figure 13A:
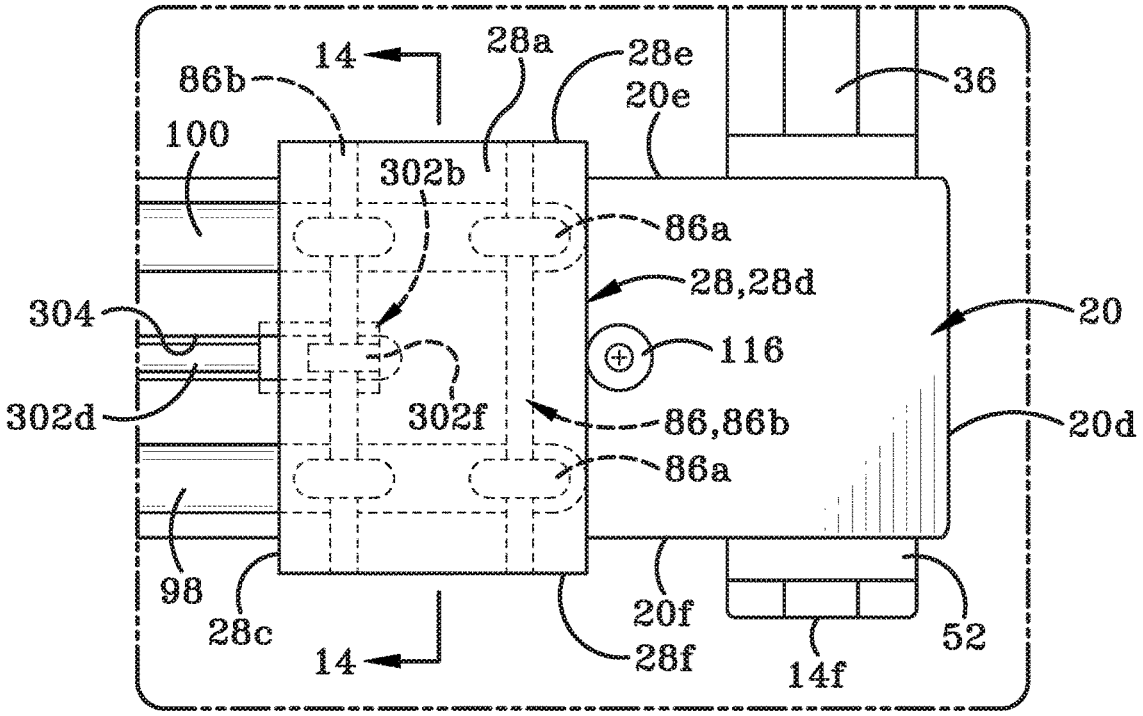
FIG. 13A is an enlarged fragmentary view of a portion of the third embodiment of the adjustable exercise machine of FIG. 13 highlighted by the dashed box labeled SEE FIG. 13A, with a strap removed.
Figure 14:
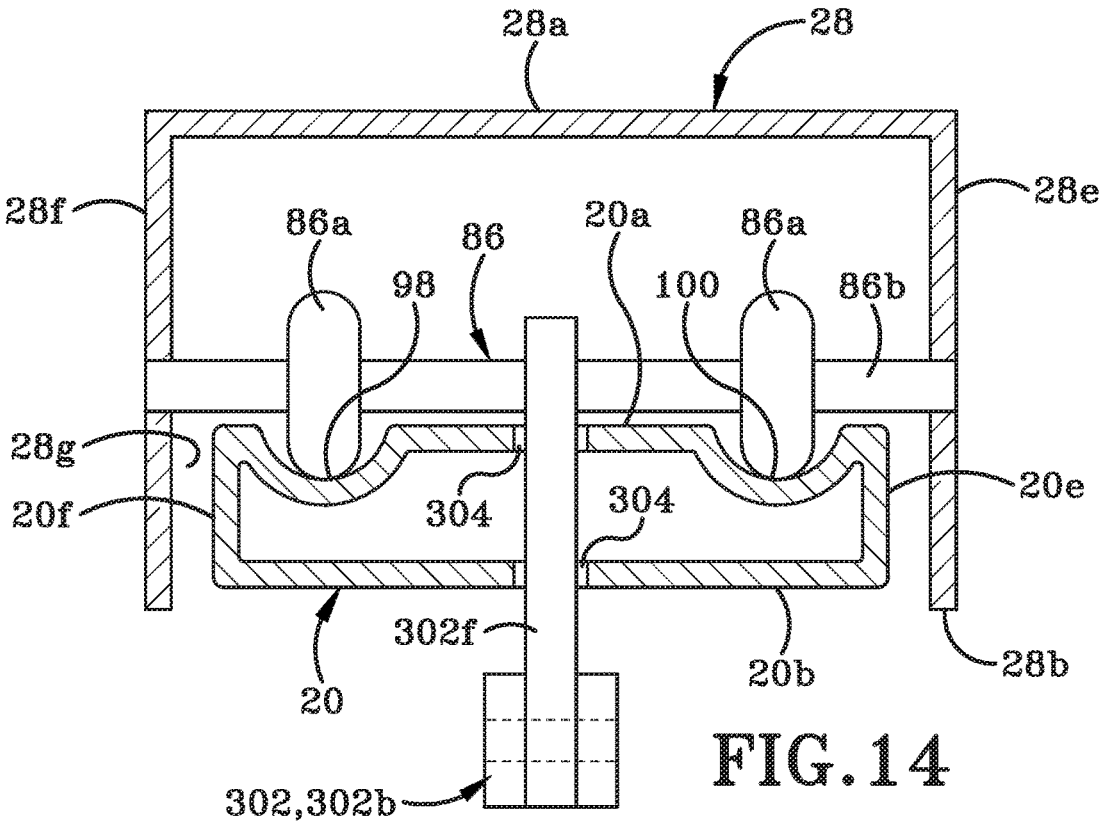
FIG. 14 is a cross section taken along line 14-14 of FIG. 13A view of the portion of the third embodiment of the adjustable exercise machine of FIG. 13.

Referring specifically to FIG. 13A and FIG. 14 an enlarged view of a portion of the third embodiment of the adjustable exercise machine 300 is shown. In this embodiment, the attachment 302*e* of the cylinder body to the machine and the attachment arm 302*f* interfacing with the respective foot block, in this case, block 28 is shown. In FIG. 13A, the attachment may be seen in dashed in the body of the block 28. While in FIG. 14, the attachment may be done by another attachment 302*f* that attaches to the first end 302*a* of the at least one piston 302. Further, the attachment of the respective foot blocks 26, 28 are operative to glide within a channel 304. The channel 304 has a width greater than that of attachment 302*f*.

Figure 15:
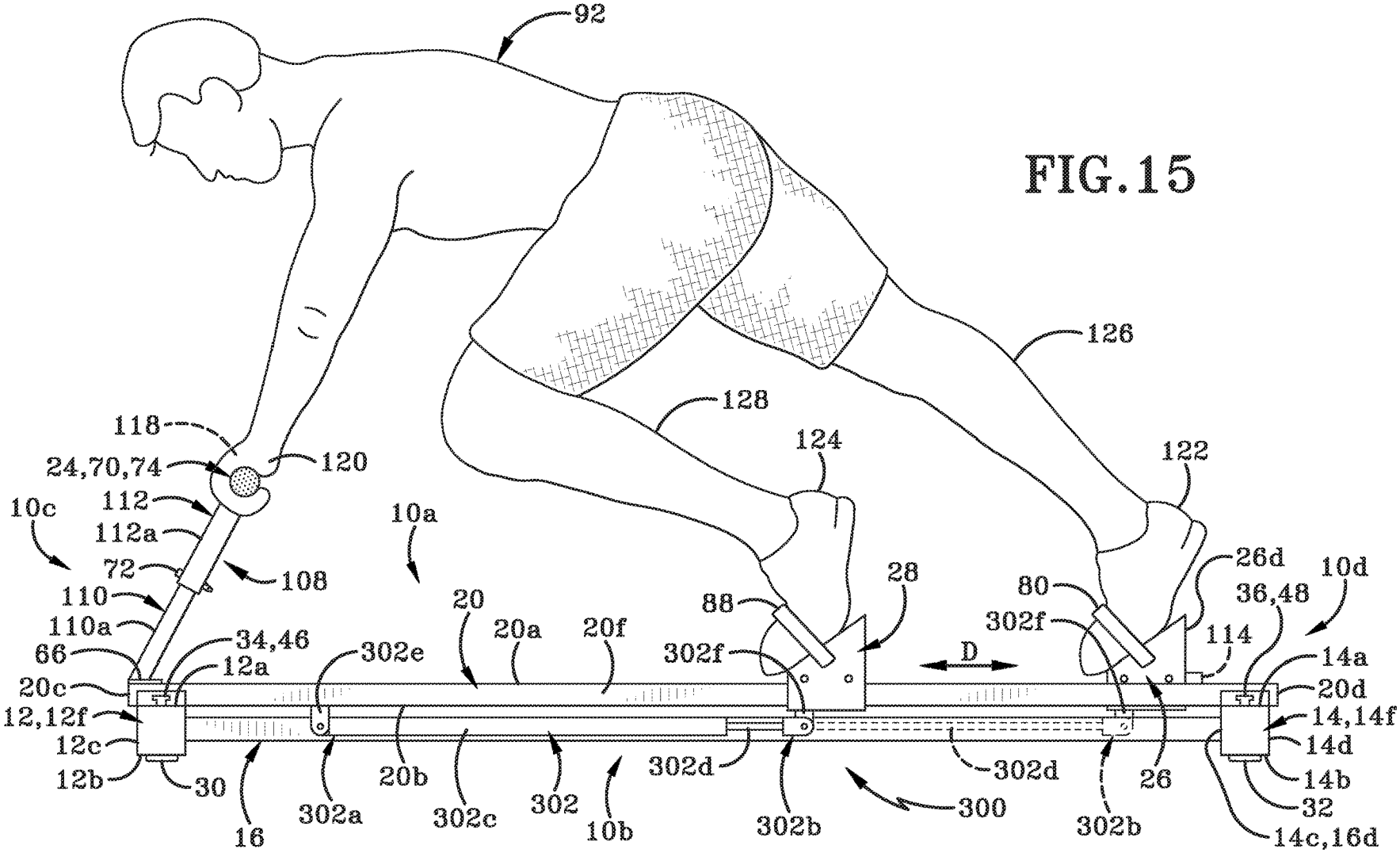
FIG. 15 is a side elevation view showing a user utilizing the third embodiment of the adjustable exercise machine of FIG. 12 to assist in the performance of a core exercise in accordance with one aspect of the present disclosure.

In operation, FIG. 15 and similar to FIG. 11A, a user 92 may utilize the adjustable exercise machine 300. User 92 may adjust the exercise machine 300 to suit their body or to suit the type of core exercise that they wish to perform on exercise machine 300. For example, and not meant as a limitation, the user 92 may move one or both of first bar 18 and second bar 20 laterally along front track 12 and rear track 14 to change the lateral distance therebetween. In one example, the first bar 18 and second bar 20 may be moved to positions that are generally in alignment with the right and left shoulders of the user 92 who will be using exercise machine; however, other configurations are entirely possible. The difference from FIG. 11A focuses on the at least one piston 302. The at least one piston 302 is operative to provide resistance in at least one direction. For example, as the piston rod 302*d* pushes into the cylinder body 302*c*, the user 92 would feel additional stress and resistance moving deeper into the cylinder body 302*c*. Further, the piston 302 may so be designed to also provide the user 92 resistance as the piston rod 302*d* is removed from the cylinder body 302*c*. As such, the piston 302 provides additional resistance for a harder activity. All the while the respective foot 26, 28 are operative to slide along the channel 304.

Figure 16A:
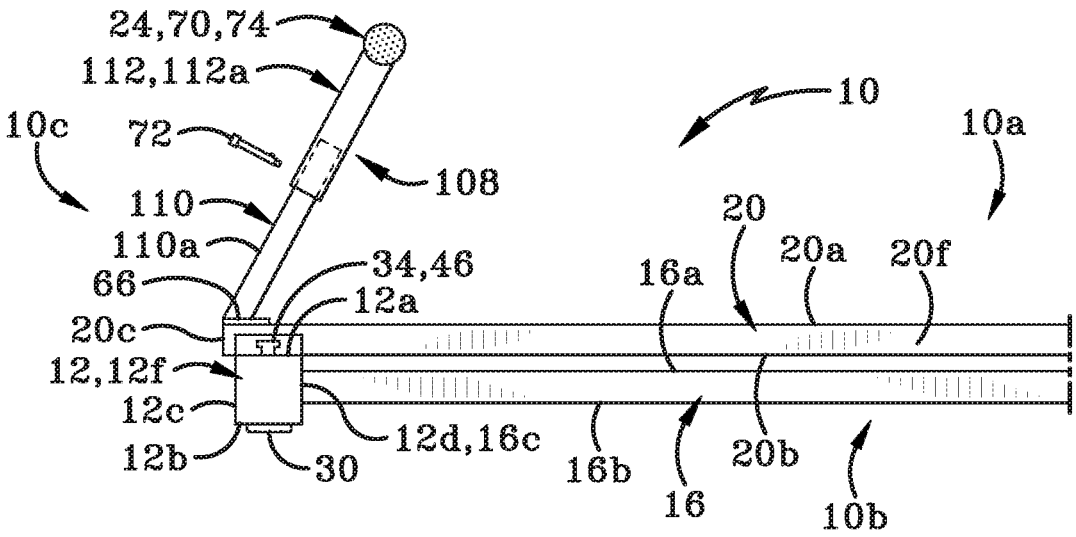
FIG. 16A is a side elevation view of the first embodiment of an adjustable exercise machine in accordance with one aspect of the present disclosure with a first height.
Figure 16B:
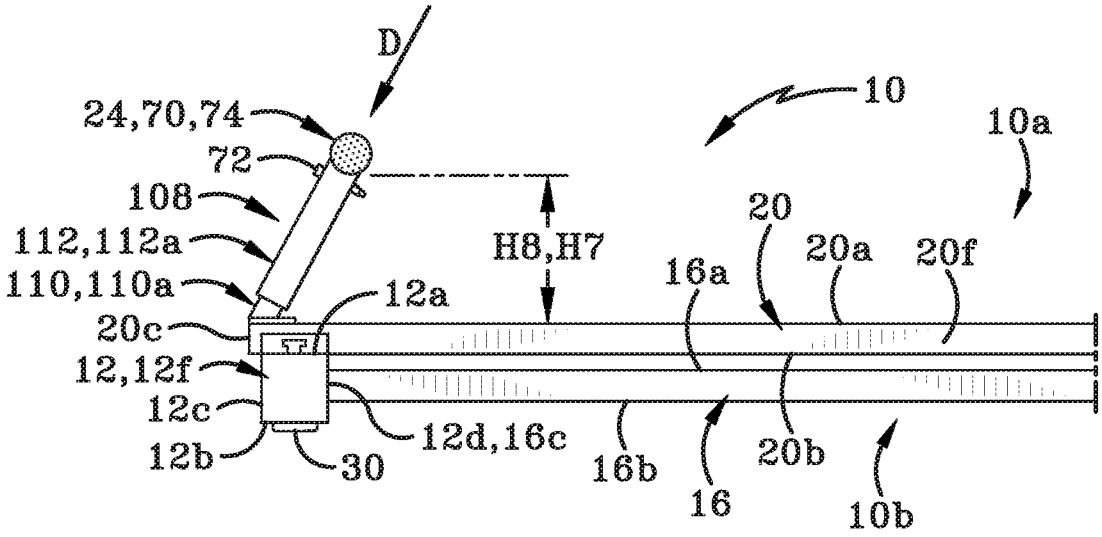
FIG. 16B is a side elevation view of the first embodiment of an adjustable exercise machine in accordance with one aspect of the present disclosure with a second height.
Figure 17:
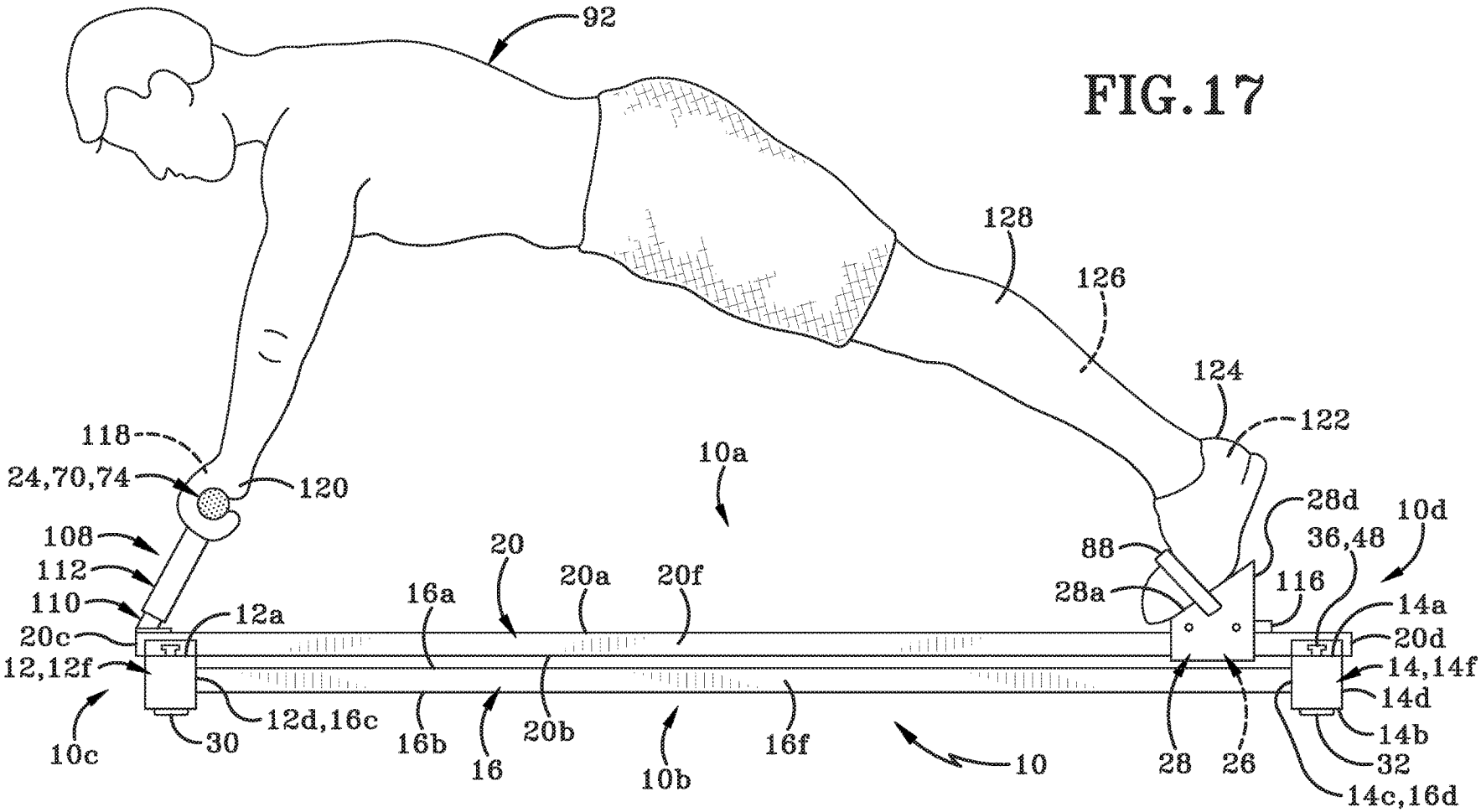
FIG. 17 is a side elevation view showing a user utilizing the first embodiment of the adjustable exercise machine to assist in the performance of a core exercise in accordance with one aspect of the present disclosure.

Referring to FIG. 16A, FIG. 16B, FIG. 17, various side elevation views of the first embodiment of an adjustable exercise machine in accordance with one aspect of the present disclosure is shown. Specifically, FIG. 16A shows the locking pin 72 removed. After the locking pin 72 is removed, the handles 58, 70 may then be moved down in direction "D" to change the height of the handle 58, 70. As a result, a user 92 may adjust the height to a new height, H7 and H8, of the handles 58, 70, respectfully, to increase the intensity of an exercise. As can be seen specifically in FIG. 17, similar to FIG. 11A, a user 92 may utilize the adjustable exercise machine 10 in the performance of a core exercise using the handles 58, 70 at their new heights H7 and H8 to increase the intensity of the exercise.

Figure 18A:
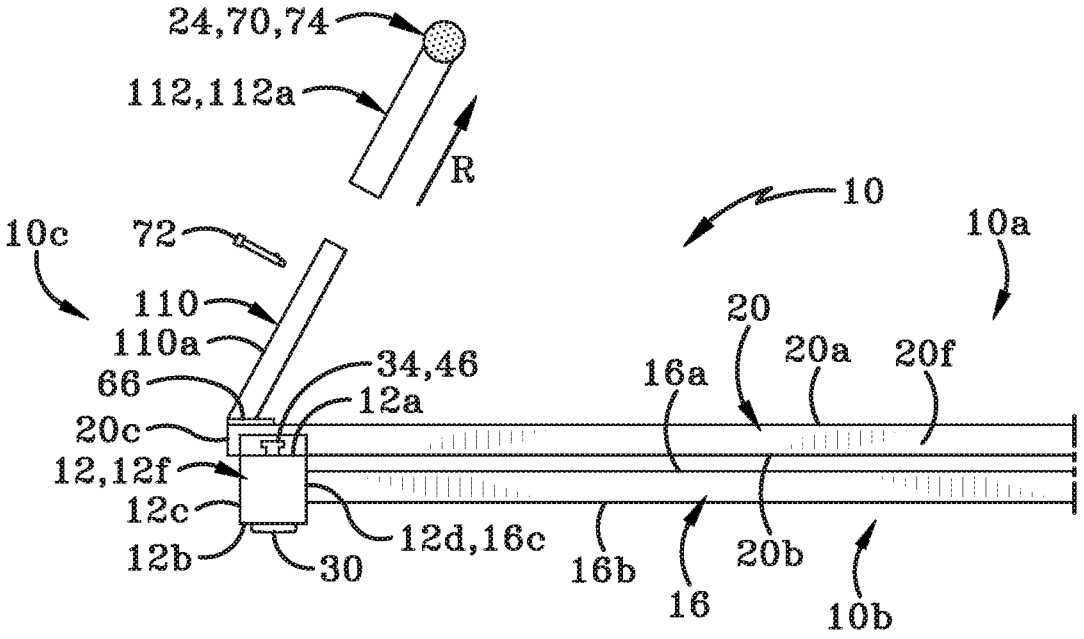
FIG. 18A is a side elevation view of the first embodiment of an adjustable exercise machine in accordance with one aspect of the present disclosure with removing a second section.
Figure 18B:
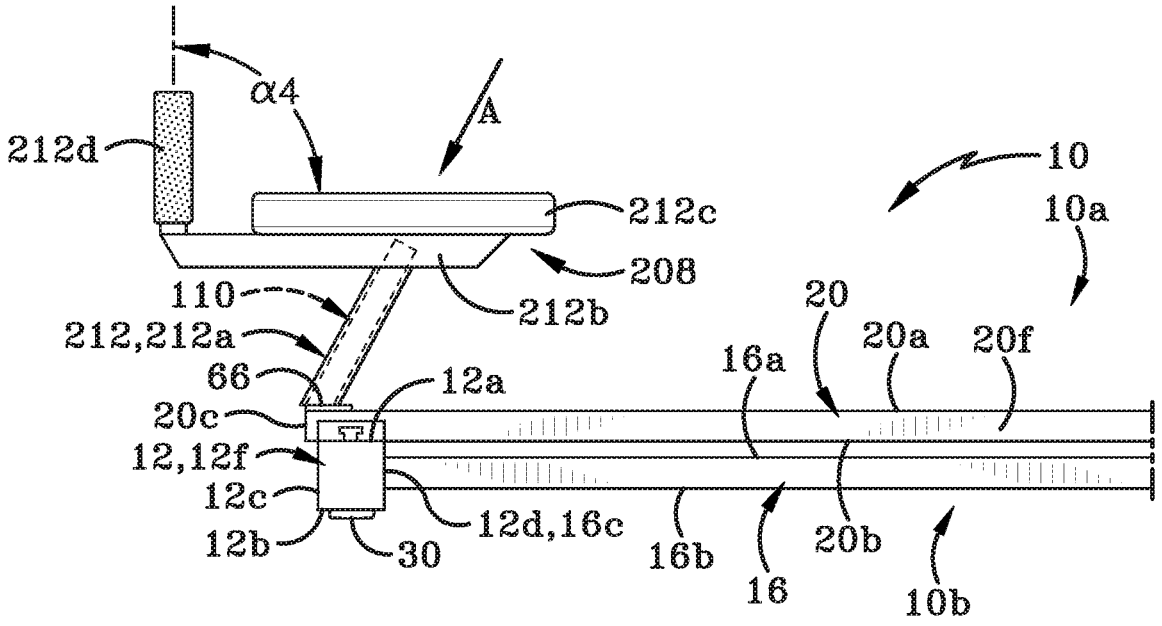
FIG. 18B is a side elevation view of the first embodiment of an adjustable exercise machine in accordance with one aspect of the present disclosure with replacing the second section with a plank portion.
Figure 19:
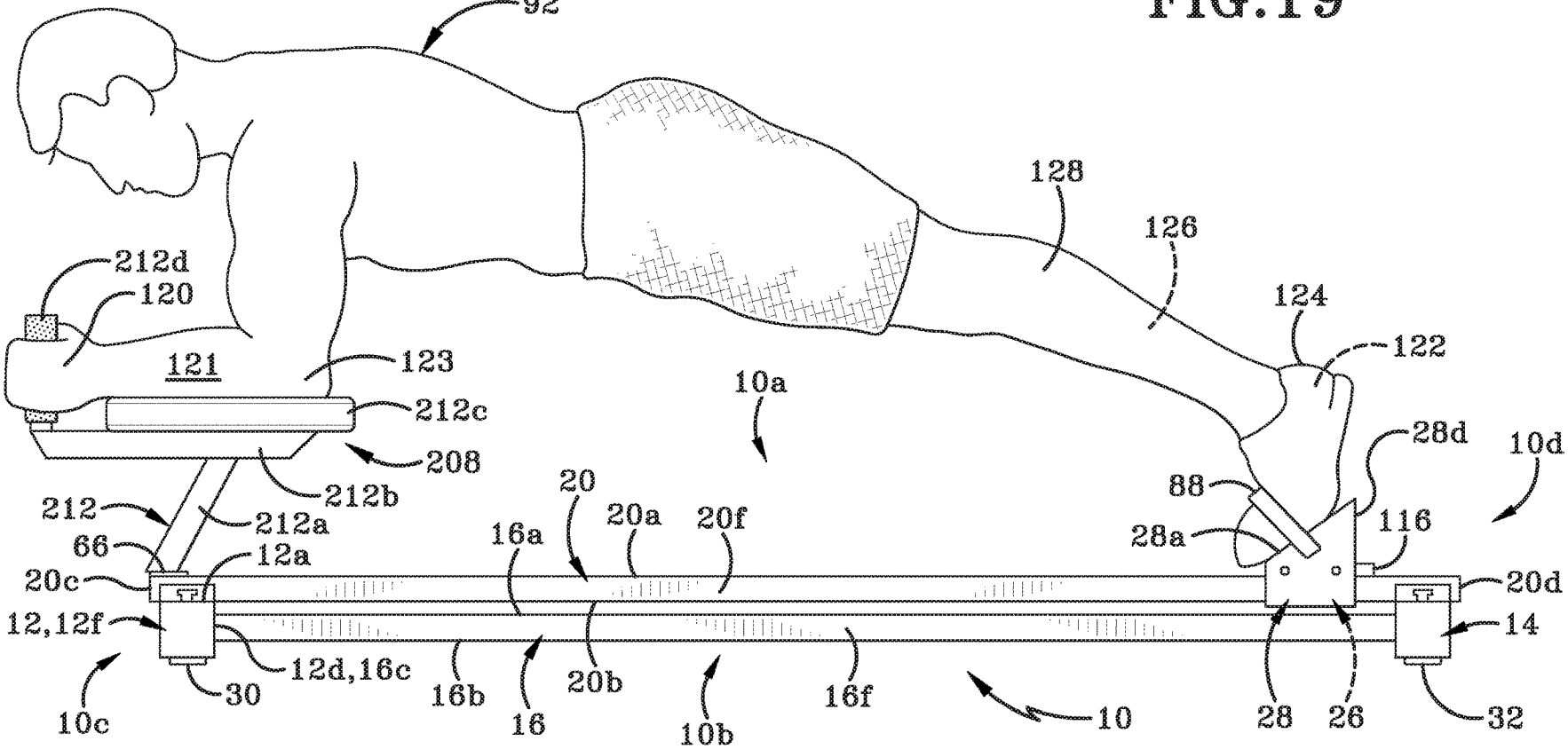
FIG. 19 is a side elevation view showing a user utilizing the first embodiment of the adjustable exercise machine to assist in the performance of a core exercise with the plank portion in accordance with one aspect of the present disclosure.

Referring now to FIG. 18A, FIG. 18B and FIG. 19, various side elevation views of the first embodiment of an adjustable exercise machine 10 is shown. In these views, it may be seen that the locking pin 72 may be removed as shown by arrow "R". As a result of removing the locking pin 72, the handle 70 may be removed to use a second embodiment of the handle. The second embodiment of the handle 212 may be seen in FIG. 18B. This handle 212 has an inner tube 212*a*, with a platform 212*b*, a padded portion 212*c* and a handle 212*d* and an angle between the handle and padded portion $\alpha_4$. The inner tube 212*a* is operative to accept the first section 110 as is shown by arrow "A". While the padded portion 212*c* is operative to pad the arms of the user 94. In this embodiment the angle $\alpha_4$ is between about 75 degrees to about 105 degrees. In a further embodiment it may be about 90 degrees. As is seen in FIG. 19, the adjustable exercise machine 10 to assist in the performance of a core exercise with the plank portion with the forearm 121 and elbow 123 to be placed into contact with the padded portion 212*c* in accordance with one aspect of the present disclosure. As such the handle 212 allows a user 94 to be placed in a plank position for a different type of workout or exercise. While not shown in this view, it will be understood that a second handle 212 that is identical to the first may be used to support the other forearm 121 and elbow 123 of a user.

Figure 20:
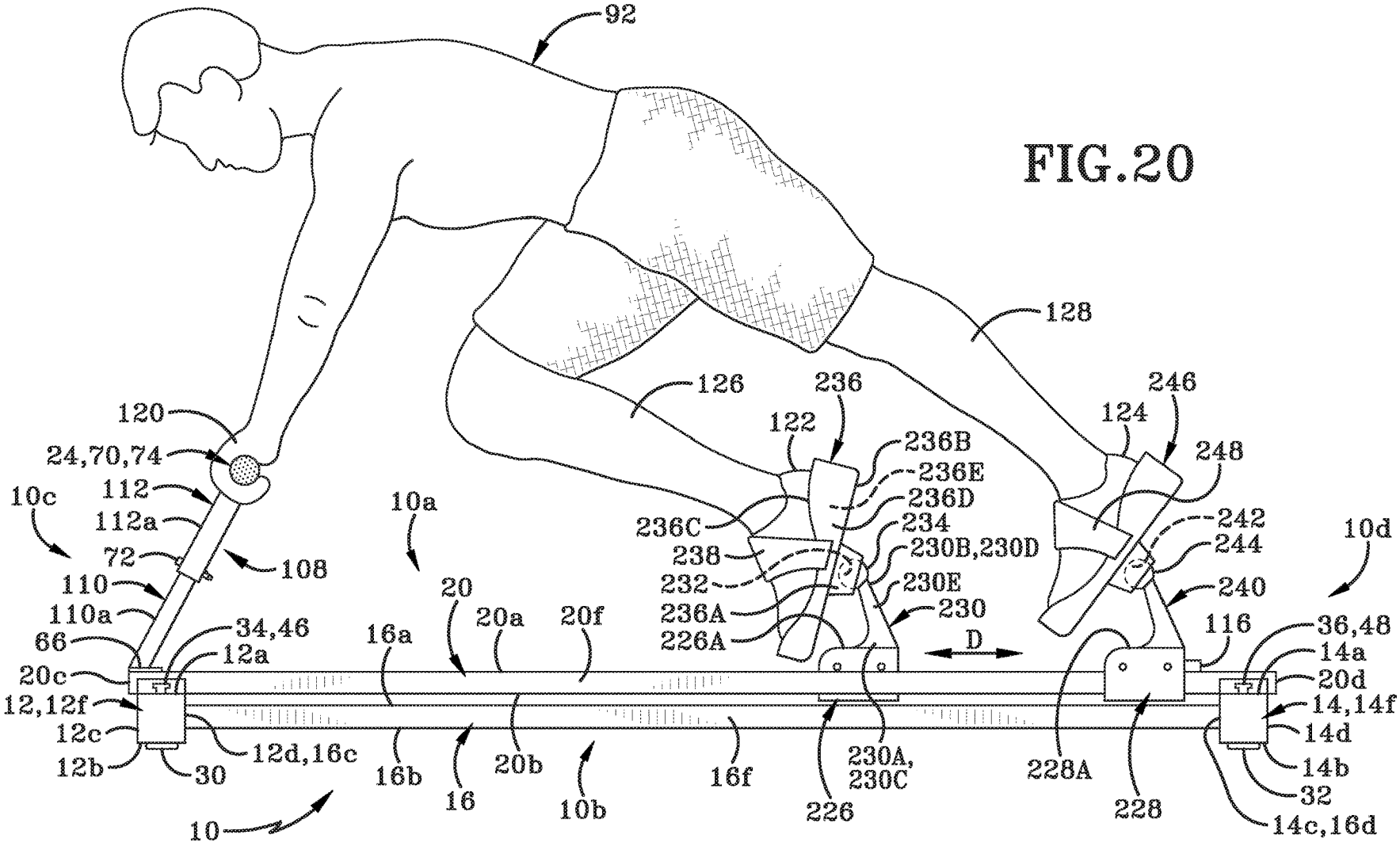
FIG. 20 is a side elevation view showing a user utilizing the first embodiment of the adjustable exercise machine with extended foot pads to assist in the performance of a core exercise in accordance with one aspect of the present disclosure.

Referring now to FIG. 20, a side elevation view showing a user utilizing the first embodiment 10 of the adjustable exercise machine with a second embodiment of foot blocks 226, 228, to assist in the performance of a core exercise in accordance with one aspect of the present disclosure is shown. Similar to the first embodiment, a first foot block 226 and second foot block 228 are identical except that a top surface 226*a* and 228*a* contain a new piece.

The first foot block 226 at its top surface 226*a* includes a ball and socket 230, 232. The ball joint portion 230 includes a first end 230*a* and a second end 230*b*. Proximate the first end is a mounting base 230*c* that attaches to the top surface 226*a* while proximate the second end is a connector base 230*d*. The mounting base 230*c* is operative to be connected engagably to the top surface 230. The connector base 230*d* includes a male ball connector 234 laterally down from a column portion 230*e* opposite from the mounting base 230*c*.

The socket portion 232 is mounted to a foot support 236 at with a connector 236*a* at its bottom side 236*b*. The foot support 236 has a body that is generally open at its top side 236*c*. The foot support 236 is further bound by a first side 236*d* and a second side 236*e* with a strap 238 spanning the first side 236*d* and second side 236*e* operative to hold the foot 122 of the user 92.

The ball and socket 230, 232 formed of interconnectable articulated inserting and receiving elements: the inserting element being a substantially spherically convexly curved male ball connector 234, and the receiving element 236*a* being a complementary substantially spherically concavely curved female socket adapted to receive male ball connector 234. Male ball connector 234 is formed with a part-spherical outer surface and the female socket is formed with a part-spherical inner surface communicating with an opening thereinto. The part-spherical inner surface of the female socket fits slideably over part-spherical outer surface of the male ball connector 234. The male ball connector 234 is more resistant to radial deformation than the female socket, whereby the male ball connector 234 is received within the female socket through opening with an engaging fit which provides load bearing support. When the male ball connector 234 is engaged in female socket, the ball and socket 230, 232 is capable of unlimited axial rotation and unlimited universal radial movement.

Additionally, one or more areas of interference contact are provided between male ball connector inserting element 234 and female socket receiving element. In some embodiments an elastically compressible biasing member, such as an o-ring or compression spring, is provided between male ball connector 234 and female socket. The biasing member is operative to be compressed by insertion force of male ball connector 234 being inserted into female socket, and the compression of the biasing member is maintained by socket opening being closed about outer surface of male ball connector 234. Accordingly, the biasing member compresses outer surface of the male ball connector 234 against inner surface of female socket so that forms a snug fit of male ball connector 234 within female socket, which results in frictional forces between outer surface of male ball connector 234 and inner surface of the female socket that resists both rotational and radial movement of ball-and-socket 230, 232.

Further, in other or similar embodiments, a seat may be provided for the biasing member for maintaining relative positioning against drag caused by movement of male ball connector 234 within female socket. By way of non-limiting example the exemplary seat is formed in the inner surface of the female socket. The seat may be a groove sized slot or indentation to receive the o-ring biasing member to a depth that retains relative positioning of the o-ring biasing member, yet causes a portion of the o-ring biasing member to partially protrude into the female socket. The protruding portion of the o-ring biasing member engages the outer surface of the male ball connector 234 and is compressed. Accordingly, the protruding portion of the o-ring biasing member forms a substantially circular area of interference contact with the outer surface of the engaged male ball connector 234 wherein frictional drag occurs.

The second foot block 228 at its top surface 228*a* includes a second ball and socket 240, 242. That are identical to those described with respect to reference numerals 230 and 232 merely attached to the second foot block 228. Further there is a second strap 248 nearly identical to the first strap 238, a second male ball connector 244 identical to the first male ball connector 234 and a second foot support 246 identical to the first foot support 236 all new parts attached to the second foot block, respectively. As such, the repeated recitation of these elements will not be done for the purposes of brevity.

Figure 21:
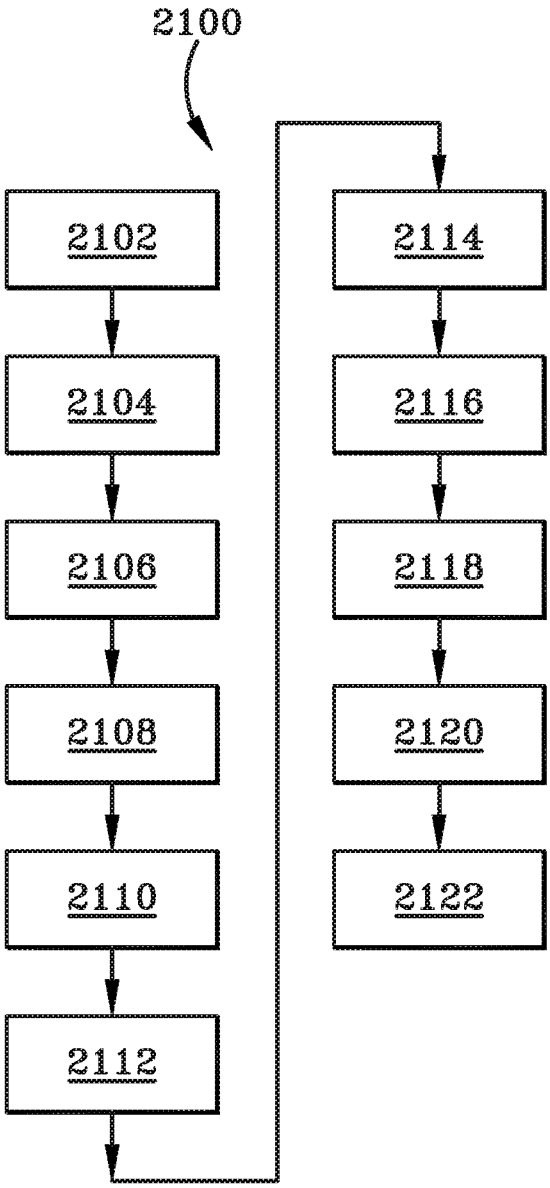
FIG. 21 is a flow chart of one method or process in accordance with the present disclosure.

FIG. 21 depicts an exemplary method or process in accordance with one aspect of the present disclosure and is generally referred to as 2100. The method 2100 includes providing an adjustable exercise machine 10 that includes a top 10*a* and a bottom 10*b* defining a vertical direction therebetween; a front end 10*c* and a rear end 10*d* defining a longitudinal direction therebetween, a first side 10*e* and a second side 10*f* defining a transverse direction therebetween, and a longitudinal center axis X1 extending from the front end 10*c* to the rear end 10*d*. The exercise machine 10 further includes a front track 12 provided proximate the front end 10*c*; a rear track 14 provided proximate the rear end 10*d*; a first bar 18 including a first end 18*c* operably engaged with the front track 12 and a second end 18*d* operably engaged with the rear track 14. The first bar 18 is provided intermediate the center axis X1 and the first side 10*e* of the machine 10. The exercise machine 10 further includes a second bar 20 having a first end 20*c* operably engaged with the front track 12 and a second end 20*d* operably engaged with the rear track 14. The second bar 20 is provided intermediate the center axis X1 and the second side 10*f*. The exercise machine 10 further includes a first handle bar 18 operably engaged with the first bar 18 proximate the front end 10*c*, and a second handle bar operably engaged with the second bar 20 proximate the front end 10. Still further, the exercise machine 10 includes a first foot block 26 operably engaged with the first bar 18 and a second foot block 28 operably engaged with the second bar 20. The first foot block 26 and second foot block are movable longitudinally along the first bar 18 and second bar toward and away from rear end 10*d*. The providing of the aforementioned machine 10 is shown generally at 2102 in FIG. 8.

The method 2100 further includes setting the position of the first bar 18 and the second bar 20 on the front track 12 and rear track 14. This step, which is shown generally at 2104, may include adjusting one or more of the first bar 18 and the second bar 20 along the front track 12 and the rear track 14 in the transverse direction. The step of adjusting may further include disengaging the locking members 44, 52 prior to adjusting the position of the first bar 18 and second bar 20, and then reengaging the locking members 44, 52 once the desired position is attained.

The method 2100 further includes setting a first height H1 of the first handle member 58 relative to the first bar 18, which is shown generally at 2106. The method includes setting a second height H2 of the second handle member 70 relative to the second bar 20, which is shown generally at 2108. The method of setting the heights of the first handle member 58 and second handle member 70 may include adjusting the position of the first handle member 58 and the second handle member 70 on the associated support member. The step of adjusting may further include disengaging the locking pins 60, 72 prior to adjusting the position of the first handle member 58 and second handle member 70 and then reengaging the locking pin 60, 72 when the desired position is attained.

The method 2100 includes setting a first distance D1 of the first foot block 26 from the second end 18*d* of the first bar 18, which is shown generally at 2110. The method includes setting a second distance D2 of the second foot block 28 from the second end 20*d* of the second bar 20, which is shown generally at 2112. The method of setting the distances of the first foot block 26 and second foot block 28 may further include adjusting the position of the first foot block 26 and second foot block 28 on the associated first bar 18 and second bar 20. The step of adjusting may further include disengaging the locking devices 84, 90 prior to adjusting the position of the first foot block 26 and the second foot block 28 and then reengaging the locking devices 84, 90.

The method 2100 further includes gripping the first handle member 58 with a first hand 118 of a user 92, which is shown generally at 2114. The method includes gripping the second handle member 70 with a second hand 120 of the user 92, which is shown generally at 2116. The method 2100 includes engaging the first foot block 26 with a first foot 122 of the user 92, which is shown generally at 2118. The method includes engaging the second foot block 28 with a second foot 124 of the user 92, which is shown generally at 2120. The method 2100 further includes performing the core exercise, such as, for example, the plank exercise, which is shown generally at 2122. Further, various other exercises or similar exercises described above could be accomplished using alternative embodiments of either exercise machine 200 or exercise machine 300.

Figure 22:
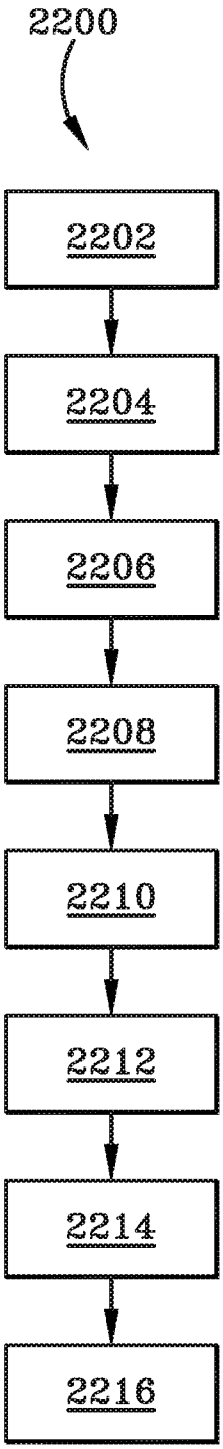
FIG. 22 is a flow chart of another method or process in accordance with the present disclosure.

FIG. 22 depicts an exemplary method or process in accordance with one aspect of the present disclosure and is generally referred to as 2200. The method 2200 includes providing an adjustable exercise machine 200 that includes a top 10*a* and a bottom 10*b* defining a vertical direction therebetween; a front end 10*c* and a rear end 10*d* defining a longitudinal direction therebetween, a first side 10*e* and a second side 10*f* defining a transverse direction therebetween, and a longitudinal center axis X1 extending from the front end 10*c* to the rear end 10*d*. The exercise machine 10 further includes a front track 12 provided proximate the front end 10*c*; a rear track 14 provided proximate the rear end 10*d*; a first bar 18 including a first end 18*c* operably engaged with the front track 12 and a second end 18*d* operably engaged with the rear track 14. The first bar 18 is provided intermediate the center axis X1 and the first side 10*e* of the machine 10. The exercise machine 10 further includes a second bar 20 having a first end 20*c* operably engaged with the front track 12 and a second end 20*d* operably engaged with the rear track 14. The second bar 20 is provided intermediate the center axis X1 and the second side 10*f*. The exercise machine 10 further includes a first handle bar 18 operably engaged with the first bar 18 proximate the front end 10*c*, and a second handle bar operably engaged with the second bar 20 proximate the front end 10. Still further, the exercise machine 10 includes a first foot block 26 operably engaged with the first bar 18 and a second foot block 28 operably engaged with the second bar 20. The first foot block 26 and second foot block are movable longitudinally along the first bar 18 and second bar toward and away from rear end 10*d*. The providing of the aforementioned machine 200 is shown generally at 2202 in FIG. 22.

The method 2200 further includes setting the position of the first bar 18 and the second bar 20 on the front track 12 and rear track 14. This step, which is shown generally at 2204, may include adjusting one or more of the first bar 18 and the second bar 20 along the front track 12 and the rear track 14 in the transverse direction. The step of adjusting may further include disengaging the locking members 44, 52 prior to adjusting the position of the first bar 18 and second bar 20, and then reengaging the locking members 44, 52 once the desired position is attained.

The method 2200 further includes setting a first height H1 of the first handle member 58 relative to the first bar 18, which is shown generally at 2206. The method includes setting a second height H2 of the second handle member 70 relative to the second bar 20, which is shown generally at 2208. The method of setting the heights of the first handle member 58 and second handle member 70 may include adjusting the position of the first handle member 58 and the second handle member 70 on the associated support member via the telescoping movement. The step of adjusting may further include disengaging the locking pins 60, 72 prior to adjusting the position of the first handle member 58 and second handle member 70 and then reengaging the locking pin 60, 72 when the desired position is attained.

The method 2200 further includes gripping the first handle member 58 with a first hand 118 of a user 92, which is shown generally at 2210. The method includes gripping the second handle member 70 with a second hand 120 of the user 92, which is shown generally at 2212. The method 2200 includes engaging the first foot block 26 with a first foot 122 of the user 92, which is shown generally at 2214. The method includes engaging the second foot block 28 with a second foot 124 of the user 92, which is shown generally at 2216. For example, and not meant as a limitation, the user 92 may move a first leg 126 forward by moving the first foot 122 longitudinally in a direction indicated by arrow "D" towards the user's midsection to a maximum movement point. Once the maximum movement point has been reached, the user 92 holds the first leg 126 in that position while flexing the user's abs. After the user 92 briefly holds the first leg 126 in that position, the user 92 returns the first leg 126 to the original position and the user performs the same movement with a second leg 128. As such, the user 92 moves the first leg 126 and the second leg 128 in an alternating manner. Alternatively, the user 92 may simultaneously move the first leg 126 and the second leg 128 toward their midsection to a maximum movement point. Once the maximum movement point has been reached, the user 92 briefly holds the first leg 126 and the second leg 128 in that position while flexing the user's abs, After the user 92 briefly holds the first leg 126 and the second leg 128 in that position, the user 92 returns the first leg 126 and the second leg 128 to the original position. As such, the user 92 moves the first leg 126 and the second leg 128 simultaneously.

Although certain exercises have been described, it is to be entirely understood that other exercises may be performed while utilizing exercise machine 200 or exercise machine 300. In the case of exercise machine 300, the foot block 26 may be engaged with a first foot 122 of the user 92. The method includes engaging the second foot block 28 with a second foot 124 of the user 92. For example, and not meant as a limitation, the user 92 may move a first leg 126 forward by moving the first foot 122 longitudinally in a direction indicated by arrow "D" towards the user's midsection to a maximum movement point. In this case the piston 302 would be fully compressed and move the second end 302*b* closer to the first end 302*a*. The piston 302 is operative to offer resistance in at least one of this direction of movement, or put another way, offer resistance as a result of the piston rod 302*d* moving in or out of the cylinder body 302*c*. Once the maximum movement point has been reached, the user 92 holds the first leg 126 in that position while flexing the user's abs. After the user 92 briefly holds the first leg 126 in that position, the user 92 returns the first leg 126 to the original position and the user performs the same movement with a second leg 128. As such, the user 92 moves the first leg 126 and the second leg 128 in an alternating manner. Alternatively, the user 92 may simultaneously move the first leg 126 and the second leg 128 toward their midsection to a maximum movement point. Once the maximum movement point has been reached, the user 92 briefly holds the first leg 126 and the second leg 128 in that position while flexing the user's abs. After the user 92 briefly holds the first leg 126 and the second leg 128 in that position, the user 92 returns the first leg 126 and the second leg 128 to the original position. As such, the user 92 moves the first leg 126 and the second leg 128 simultaneously. The movement of the piston rod 302*d* in and out of the cylinder body 302*c* creates added force and resistance for a user with respect to the movements of both directions.

It will further be understood that first bar 18 and second bar 20 may be provided with a different mechanism other than the cooperating inserts 34, 36, and slots 46, 48 to permit them to move transversely relative to front track 12 and rear track 14. For example, first bar 18 and second bar 20 may be provided with through-holes on their first end 18*c*, 20*c* and second end 18*d*, 20*d* that are alignable with through-holes defined in front track 12 and rear track 14. An appropriate locking member may be inserted through the aligned holes to secure first bar 18 and second bar 20 to front track 12 and rear track.

It will further be understood that first bar 18 and second bar 20 may be provided with upstanding inserts similar to inserts 34, 36 and that first foot block 26 and second foot block 28 may be provided with complementary slots therein that receive the inserts on first bar 18 and second bar 20. First foot block 26 and second foot block 28 may then slide longitudinally relative to first bar 18 and second bar 20 in a way similar to how first bar 18 and second bar 20 slide relative to front track 12 and rear track 14. Appropriate locking device will be provided to selectively lock first foot block 26 and second foot block 28 in a fixed position so that exercise machine 10 may be utilized.

It will be understood that first handle bar assembly member 22 and second handle bar assembly member 24 may be differently configured from what is illustrated in FIGS. 1-7 and FIGS. 8-11B. For example, the support member of each of the first handle bar assembly 22 and second handle bar assembly 24 may be pivotable about a pivot axis so as to angle the user's arms while performing a core exercise.

It will be understood that first handle bar assembly member 22 and second handle bar assembly member 24 in one embodiment are differently configured from what is illustrated in FIGS. 1-7 and FIGS. 8-11B. For example, instead of the first handle member 58 and the second handle member 70 having respective gripping portions 62 and 74 respectively, the first handle member 58 and the second handle member 70 may each have elbow receiving portions configured to receive a user's elbows 123 and forearms 121, as can be seen on FIG. 18B and FIG. 19. As such a user may use the machine as a planking machine.

For further example, the handle bar first handle bar assembly member 22 and second handle bar assembly member 24 may be adjusted, as is seen in FIG. 16A and FIG. 16B, as discussed earlier. This may lead to different modified workouts, including but not limited to, deeper arm and core workouts as the increased stress would be felt by a user.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A machine for performing core exercises, comprising:

a front track and a rear track spaced longitudinally apart from one another;

at least one bar engaged with the front track and the rear track, wherein the at least one bar is selectively adjustable in a transverse direction along the front track and along the rear track;

at least one handle bar assembly engaged with the at least one bar; and at least one foot block engaged with the at least one bar, wherein the at least one handle bar assembly and the at least one foot block are longitudinally spaced apart from one another.

2. The machine of claim 1, wherein the rear track is aligned substantially parallel to the front track.

3. The machine of claim 1, wherein the at least one bar comprises:

a first bar operably engaged with the front track and the rear track; and a second bar operably engaged with the front track and the rear track; wherein the second bar is oriented substantially parallel to the first bar and is spaced transversely therefrom.

4. The machine of claim 1, wherein the at least one handle bar assembly comprises:

a first handle bar assembly operably engaged with the first bar proximate a first end of the first bar; and a second handle bar assembly operably engaged with the second bar proximate a first end of the second bar.

5. The machine of claim 4, wherein the first bar includes a first end and a second end; and the second bar includes a first end and a second end; and wherein the exercise machine further comprises:

a first distance of the first foot block from the second end of the first bar; and a second distance of the second foot block from the second end of the second bar; and wherein one or both of the first distance and the second distance is selectively adjustable.

6. The machine of claim 4, wherein the at least one foot block comprises:

a first foot block operably engaged with the first bar a distance longitudinally rearward from the first handle bar assembly; and a second foot block operably engaged with the second bar a distance longitudinally rearward from the second handle bar assembly.

7. The machine f of claim 1, further comprising:

a first handle member provided on the first handle bar assembly; and a second handle member provided on the second handle bar assembly; wherein the first handle member is located at a first height relative to the first bar; and the second handle member is located at a second height relative to the second bar; and wherein one or both of the first height and the second height is selectively adjustable.

8. The machine of claim 1, wherein the at least one handle bar assembly comprises:

at least one handle bar; and at least one platform adapted to accept a forearm of a user.

9. The machine of claim 1, further comprising:

at least one piston engaged with the at least one foot block.

10. The machine of claim 9, wherein the at least one foot block comprises a first foot block and a second foot block, and wherein the at least one piston comprises:

a first piston operatively coupled to the first foot block; and a second piston operatively coupled to the second foot block.

11. The machine of claim 1, wherein the at least one bar is oriented 90° relative to the front track and the rear track.

12. The machine of claim 1, wherein the at least one foot block further comprises:

at least one ball and socket joint engaging the at least one foot block to the at least one bar, wherein the at least one ball and socket joint is operative to provide unlimited axial rotation and unlimited universal radial movement to the at least one foot block relative to the at least one bar.

13. The machine of claim 1, wherein the at least one foot block further comprises:

at least one strap that spans from a first side to a second side of the at least one foot block operative to hold at least one foot of a user.

14. A machine for performing core exercises, comprising:

a front track;

a rear track spaced longitudinally rearwardly from the front track and aligned substantially parallel to the front track;

a first bar operably engaged with the front track and the rear track;

a second bar operably engaged with the front track and the rear track, wherein the second bar is oriented substantially parallel to the first bar and is spaced transversely therefrom;

a first handle bar assembly operably engaged with the first bar proximate a first end of the first bar;

a second handle bar assembly operably engaged with the second bar proximate a first end of the second bar; and at least one foot block engaged with one of the first bar and the second bar;

wherein one or both of the first bar and the second bar is selectively adjustable in the transverse direction along the front track and along the rear track.

15. The machine of claim 14, further comprising:

a first handle member provided on the first handle bar assembly; and a second handle member provided on the second handle bar assembly; wherein the first handle member is located at a first height relative to the first bar; and the second handle member is located at a second height relative to the second bar; and wherein one or both of the first height and the second height are selectively adjustable.

16. The machine of claim 14, wherein the first bar includes a first end and a second end; and the second bar includes a first end and a second end; and wherein the exercise machine further comprises:

a first distance of the first foot block from the second end of the first bar; and a second distance of the second foot block from the second end of the second bar; and wherein one or both of the first distance and the second distance are selectively adjustable.

17. The machine of claim 14, wherein the at least one foot block comprises:

a first foot block operably engaged with the first bar a distance longitudinally rearward from the first handle bar assembly; and a second foot block operably engaged with the second bar a distance longitudinally rearward from the second handle bar assembly.

18. A method of performing a core exercise, comprising:

spacing a front track and a rear track of a machine for use in performing the core exercise substantially parallel to one another and a distance longitudinally apart from one another;

engaging a first bar and a second bar of the machine to the front track and the rear track, such that the first bar and the second bar are oriented substantially parallel to one another and are spaced transversely from one another;

operably engaging a first handle bar assembly of the machine with the first bar proximate a first end of the first bar;

operably engaging a second handle bar assembly of the machine with the second bar proximate a first end of the second bar;

engaging a first foot block of the machine with the first bar proximate a second end of the first bar;

engaging a second foot block of the machine with the second bar proximate a second end of the second bar;

selectively adjusting one or both of the first bar and the second bar in the transverse direction along the front track and the rear track;

positioning a user's body on the machine such that the user's hands engage the first handle bar assembly and the second handle bar assembly, and the user's feet engage the first foot block and the second foot block; and performing the core exercise.

19. The method of claim 18, wherein the step of performing further comprises:

moving at least one foot of a user along one of the front track and rear track;

engaging a piston rod with a cylinder attached to a foot block as a result of the movement; and providing additional resistance to the user as a result of the movement of the piston rod.

20. The method of claim 18, wherein positioning the user's body includes:

engaging a first foot of the user in the first foot block;

engaging a second foot of the user in the second foot block;

gripping the first handle member on the first handle bar assembly with a first hand of a user; and gripping the second handle member of the second handle bar assembly with a second hand of the user.

21. The method of claim 18, further comprising:

selectively adjusting one or more of:

a first height of the first handle member assembly relative to the first bar;

a second height of the second handle member assembly relative to the second bar;

a first distance of the first foot block from the front track; and a second distance of the second foot block from the front track.

22. The method of claim 21, wherein the performing of the core exercise is done without any movement of a first foot or a second foot of the user.

23. The method of claim 20, wherein each of the first handle assembly and the second handle assembly further comprises a plank member having a platform; and wherein the method further comprises:

engaging the plank member with a forearm of the user while gripping a respective one of the first handle member and the second handle member.

24. The method of claim 20, wherein the engaging steps further comprise:

adjusting the first foot block attached to a ball and socket;

strapping the first foot into the first foot block;

adjusting the second foot block attached to a ball and socket; and strapping the second foot into the second foot block.

* * * * *